US012467322B2

(12) United States Patent
Eiman et al.

(10) Patent No.: US 12,467,322 B2
(45) Date of Patent: Nov. 11, 2025

(54) RESETTABLE LATCH ASSEMBLY WITH ENERGY TRANSFER LINE(S) FEED THROUGH

(71) Applicant: Halliburton Energy Services, Inc., Houston, TX (US)

(72) Inventors: Tyson H. Eiman, Carrollton, TX (US); Gustavo Dias De Casto Cervo, Carrollton, TX (US); Kevin Harrell, Carrollton, TX (US); Jason P. Witte, Carrollton, TX (US); Gary J. Geoffroy, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 127 days.

(21) Appl. No.: 18/500,822

(22) Filed: Nov. 2, 2023

(65) Prior Publication Data

US 2025/0146366 A1 May 8, 2025

(51) Int. Cl.
*E21B 17/04* (2006.01)

(52) U.S. Cl.
CPC ..... *E21B 17/04* (2013.01)

(58) Field of Classification Search
CPC ..... E21B 17/04
See application file for complete search history.

(56) References Cited

U.S. PATENT DOCUMENTS 4,433,726 A 2/1984 Preston, Jr. et al.
4,778,008 A 10/1988 Gonzalez et al.
5,004,272 A 4/1991 Kipp
8,061,430 B2 * 11/2011 Du ..... E21B 17/023 166/207
8,122,967 B2 2/2012 Richards
8,496,064 B2 7/2013 Du et al.
8,985,230 B2 3/2015 Crow et al.
9,404,314 B2 * 8/2016 Perez ..... E21B 17/028
10,704,339 B2 7/2020 El Mallawany et al.
11,193,339 B2 * 12/2021 El Mallawany .... E21B 17/0285
11,859,452 B2 * 1/2024 Bishop ..... E21B 19/16
12,104,441 B2 * 10/2024 Keane ..... E21B 47/135
2006/0260818 A1 11/2006 Meijer et al.
2008/0029274 A1 * 2/2008 Rytlewski ..... E21B 17/1035 166/380

(Continued)

FOREIGN PATENT DOCUMENTS

WO 2022236083 A1 11/2022

OTHER PUBLICATIONS

D&L Oil Tools, Permapak Accessories, Anchor latch assembly, Feb. 2016.

(Continued)

*Primary Examiner* — Taras P Bemko
(74) *Attorney, Agent, or Firm* — Scott Richardson; C. Tumey Law Group PLLC

(57) ABSTRACT

In general, in one aspect, embodiments relate to a resettable latch assembly for latching downhole to a mating mandrel; that comprises a mandrel, a latch collet disposed on the mandrel, wherein the latch collet is radially flexible with respect to the mating mandrel, and an energy transfer line extending a length of the mandrel; wherein the resettable latch assembly is latchable, releasable, and relatchable to the mating mandrel with translational movement.

18 Claims, 16 Drawing Sheets

(56) References Cited

U.S. PATENT DOCUMENTS

| | | | | |
|---|---|---|---|---|
| 2012/0181045 | A1* | 7/2012 | Thomas | E21B 17/003 166/242.6 |
| 2012/0205117 | A1 | 8/2012 | Harms | |
| 2013/0153207 | A1 | 6/2013 | Lauderdale | |
| 2022/0333463 | A1 | 10/2022 | Steele | |

OTHER PUBLICATIONS

Parveen, Anchor latch seal assembly, brochure. Available at https://parveen.in/wp-content/uploads/2019/12/Anchor-Latch-Seal-Assembly11.pdf, Oct. 2023.
Schlumberger, Quantum Anchor latch assembly, 2014.
Weatherford, UltraPak Snap Latch anchor seal assembly, 2008.
Halliburton, Sand Control Catalog, Versa-Latch Seal Assembly, p. 93 of 229. Available at https://www.halliburton.com/en/completions/well-completions/sand-control, Oct. 2023.
Halliburton, Packers Catalog, Ratch-Latch Anchor Assembly, p. 51 of 66. Available at https://cdn.brandfolder.io/OUSGG99Q/as/xpsnqgqpjk399b3g75pgkx4c/Packers_-_Catalog.pdf, Oct. 2023.
International Search Report and Written Opinion for International Patent Application No. PCT/US2023/079736 dated Jul. 24, 2024. PDF file. 7 pages.

* cited by examiner

RESETTABLE LATCH ASSEMBLY WITH ENERGY TRANSFER LINE(S) FEED THROUGH

BACKGROUND

Boreholes may be drilled into subterranean formations for the potential recovery of hydrocarbons or other resources. Some borehole servicing methods employ tubular members, tools, and other assemblies that are conveyed within the borehole for various purposes throughout the life of the borehole, such as in treatment and production applications. The tubular members and tools may also be retrieved from the borehole for a variety of purposes. Energy transfer lines may also be installed in the boreholes. Energy transfer lines can transfer energy through the wellbore, including electricity, fiberoptics, and hydraulics, for any of a variety of functions. In some instances, the energy transfer lines are routed in the borehole to enable communication with downhole tools. When deploying tubular members separately that have feedthrough of energy transfer lines, they need to be latched together downhole to provide a mechanical connection while also providing for feedthrough of the energy transfer lines. However, the process of connecting and disconnecting the tubular members with energy transfer line feed through can be challenging. For example, the tubular member may need to be latched and unlatched multiple times to confirm feed through connection. In addition, latching may need to straight upward and downward tubing movement to avoid damaging the energy transfer lines.

BRIEF DESCRIPTION OF THE DRAWINGS

These drawings illustrate certain aspects of some of the embodiments of the present disclosure and should not be used to limit or define the disclosure.

DETAILED DESCRIPTION

Figure 1:
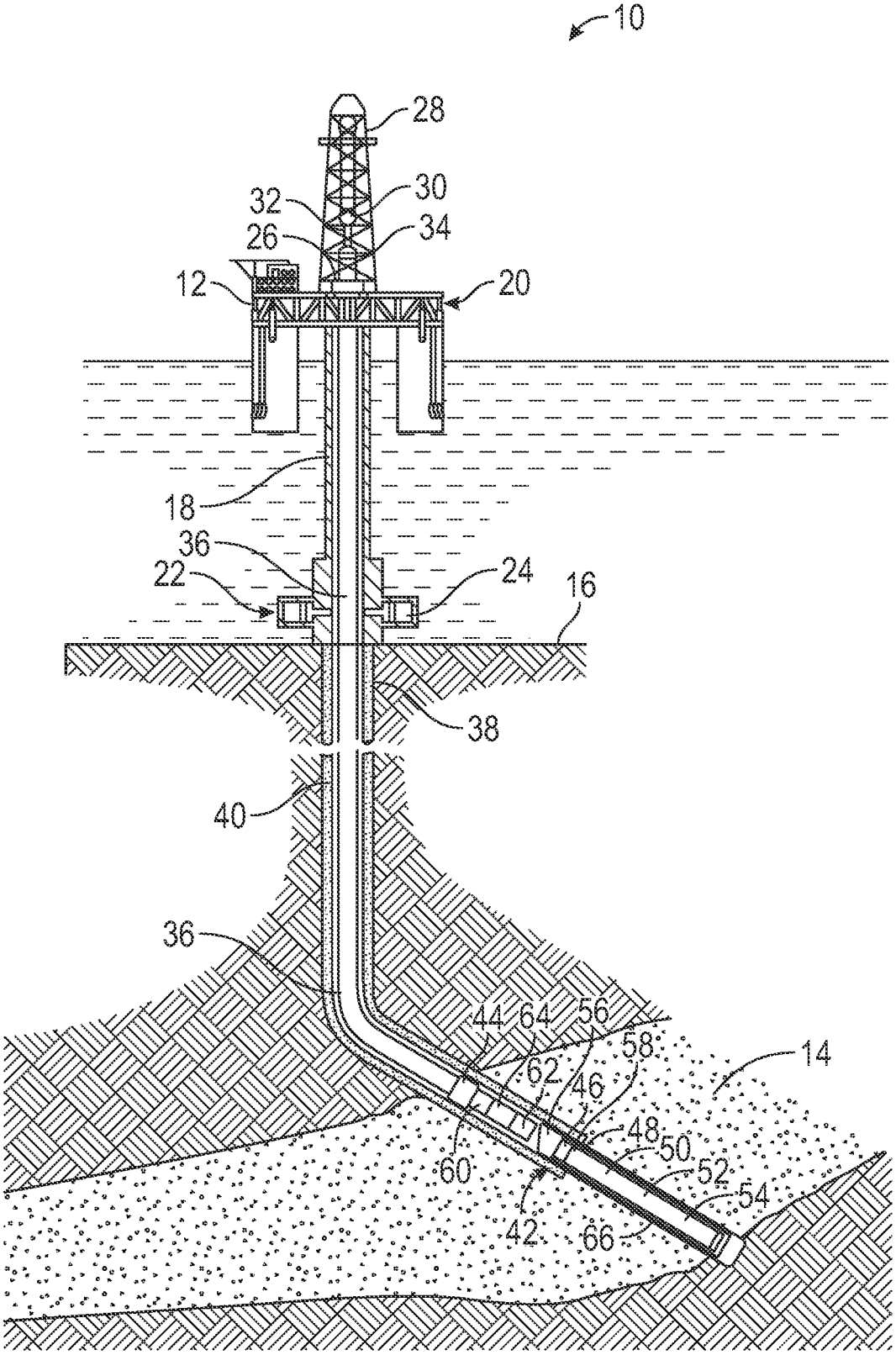
FIG. 1 is a schematic view of a well system in accordance with some embodiments of the present disclosure.

Example embodiments disclose a resettable latch assembly and, more particularly, disclose a resettable latch assembly that lands and latches in a mating assembly with feed through of energy transfer line(s). After release from engagement, the resettable latch assembly can be reset and relatched multiple times with repeatability while maintaining relative spacing between latch assembly and adjoining equipment.

Current tubular assemblies may have latch assemblies with threaded profiles that provide a one-time engagement with the mating assembly that is not repeatable. Releasing the resettable latch assembly from the mating assembly then may require shearing out with a straight pull or rotation to release. Once sheared out, the operator should then pull the resettable latch assembly out of hole as the latch assembly cannot reengage. Latch assemblies that use rotation to unlatch may not be desirable with energy transfer lines as rotation may damage such lines. Some alternative designs without threaded profiles may use collets, which can allow for multiple engagements/disengagements, but the load can be limited based on the snap value of the collets and can also result in some residual travel once installed.

Accordingly, example embodiments provide a resettable latch assembly that can be latched and released multiple times with straight upward and downward tubing movement while providing for feed through of an energy transfer line. Advantageously, the latching and release may be repeatable while maintaining location of the resettable latch assembly relative to adjoining equipment. For example, example embodiments provide for multiple releases and relatches to allow for multiple fiber connection attempts without tripping the resettable latch assembly out of the borehole. Even further, because example embodiments of the latch assembly release with translational movement (e.g., push and/or pull) and not rotational movement, the energy transfer lines on the resettable latch assembly may be less susceptible to damage.

Example embodiments provide for feed through of energy transfer lines. Examples of suitable energy transfer line may comprise any of a variety of suitable conduits suitable of transfer of energy, including fiberoptic lines for carrying light, EM transmission lines for carrying electromagnetic waves, hydraulic control lines for carrying hydraulic fluid, and electrical wires for carrying electric current. In some examples, the resettable latch assembly may provide a fiberoptic feedthrough. For example, the resettable latch assembly may enable running of fiberoptic lines across an oil and gas producing formation, water injector, or a geothermal formation, among others. The resettable latch assembly enable running of a single energy transfer line or multiple energy transfer lines on the assembly. The energy transfer lines run on the resettable latch assembly may be the same type of energy transfer line (e.g., fiberoptic lines, hydraulic lines, electrical wires, etc.) or may be different types of energy transfer liens (e.g., combination of fiberoptic lines, hydraulic line, and/or electrical wire). The resettable latch assembly may be used, for example, with a fiberoptic connector (e.g., wet mate connector) to provide the ability to latch and lock the fiberoptic line on the resettable latch assembly to an adjacent wet mate connector. Examples also provide a method of connecting and locking a fiberoptic wet mate connector to prevent disconnection of the wet mate connection during downhole activities, such as production or injection.

FIG. 1 illustrates a well system 10 in accordance with one or more embodiments of the present disclosures. As illustrated, a semi-submersible platform 12 is centered over a subterranean formation 14 located below sea floor 16. A subsea conduit 18 extends from deck 20 of semi-submersible platform 12 to wellhead installation 22, including blowout preventers 24. Among other components, semi-submersible platform 12 may comprise a hoisting apparatus 26, a derrick 28, a travel block 30, a hook 32, and a swivel 34 for raising and lowering pipe strings, such as tubular assembly 36. The tubular assembly 36 may be any suitable downhole tubing string or tubular member for use in well system 10, including a production tubing and coiled tubing, for example.

In the illustrated embodiment, a borehole 38 extends through the various earth strata including subterranean formation 14. An upper portion of borehole 38 comprises casing 40 that is cemented within borehole 38. Also disposed in borehole 38 is a completion 42 that comprises various tools such as packer 44 and seal bore assembly 46 in a cased portion of borehole 38 and sand control screen assemblies 48, 50, 52, 54 in an openhole portion of borehole 38. In the illustrated embodiment, completion 42 also comprises a mating assembly 56 that houses a downhole wet mate connector 66. Extending downhole from downhole wet mate connector 66 is a downhole energy transfer line 58 that is operably associated with sand control screen assemblies 48, 50, 52, 54. In the illustrated embodiment, downhole energy transfer lines 58 extends down the sand control screen assemblies 48, 50, 52, 54. In certain embodiments, downhole energy transfer line 58 may operate as an energy conductor including power and data transmission between downhole a location or downhole sensors (not pictured) and the surface. In other embodiments, downhole energy transfer line 58 may operate as a downhole sensor.

For example, when fiberoptic lines are used as downhole energy transfer line 58, the fiberoptic lines may be used to obtain distributed measurements representing a parameter along the entire length of the fiberoptic lines such as distributed temperature sensing. In this embodiment, a pulse of laser light from the surface is sent along the fiberoptic line and portions of the light are backscattered to the surface due to the optical properties of the fiber. The slightly shifted frequency of the backscattered light provides information that is used to determine the temperature at the point in the fiber where the backscatter originated. In additions as the speed of light is constant, the distance from the surface to the point where the backscatter originated can also be determined. In this manner, continuous monitoring of the backscattered light will provide temperature profile information for the entire length of the fiber. By way of further example, fiberoptic lines may provide a wide variety of measurements, including temperature, pressure, vibration, and acoustics.

Disposed in borehole 38 at the lower end of tubular assembly 36 may be a variety of tools, including resettable latch assembly 60 having wet mate connector 62. Extending uphole of wet mate connector 62 is an energy transfer line 64 that extends to the surface. While FIG. 1 illustrates energy transfer line 64 in the annulus between tubular assembly 36 and borehole 38 it may be installed on the tubular assembly 36 in a different configuration (e.g., inside). In some embodiments, the energy transfer line 64 may be coupled to tubular assembly 36 to prevent damage during installation. In some embodiments, energy transfer line 64 may be the same type of line as downhole energy transfer line 58, for example, to permit energy transmission following the connection process. As discussed in greater detail below, prior to producing fluids, such as hydrocarbon fluids, from subterranean formation 14, tubular assembly 36 and completion 42 may be connected together.

The resettable latch assembly 60 may be used to connect and provide an energy pathway from the tubular assembly 36 to the completion 42 (or other suitable lower tool in borehole 38). In accordance with present embodiments, the resettable latch assembly 60 may be resettable to ensure an operative connection is made between the energy transfer line 64 and the downhole energy transfer line 58. In accordance with present embodiments, the resettable latch assembly 60 may be latched, released, and relatched to the mating assembly 56 multiple times before locking the connection. As discussed in greater detail below, example embodiments may comprise translational movement of resettable latch assembly 60 for releasing and relatching the resettable latch assembly 60 with the mating assembly.

Even though FIG. 1 depicts a slanted wellbore, it should be understood by those skilled in the art that the resettable latch assembly 60 as disclosed herein is equally well suited for use in wellbores having other orientations including vertical wellbores, horizontal wellbores, multilateral wellbores or the like. Accordingly, it should be understood by those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure. Also, even though FIG. 1 depicts an offshore operation, it should be understood by those skilled in the art that the resettable latch assembly 60 as disclosed herein is equally well suited for use in onshore operations. Further, even though FIG. 1 depicts an open hole completion, it should be understood by those skilled in the art that the resettable latch assembly 60 as disclosed herein is equally well suited for use in cased hole completions.

Figure 2:
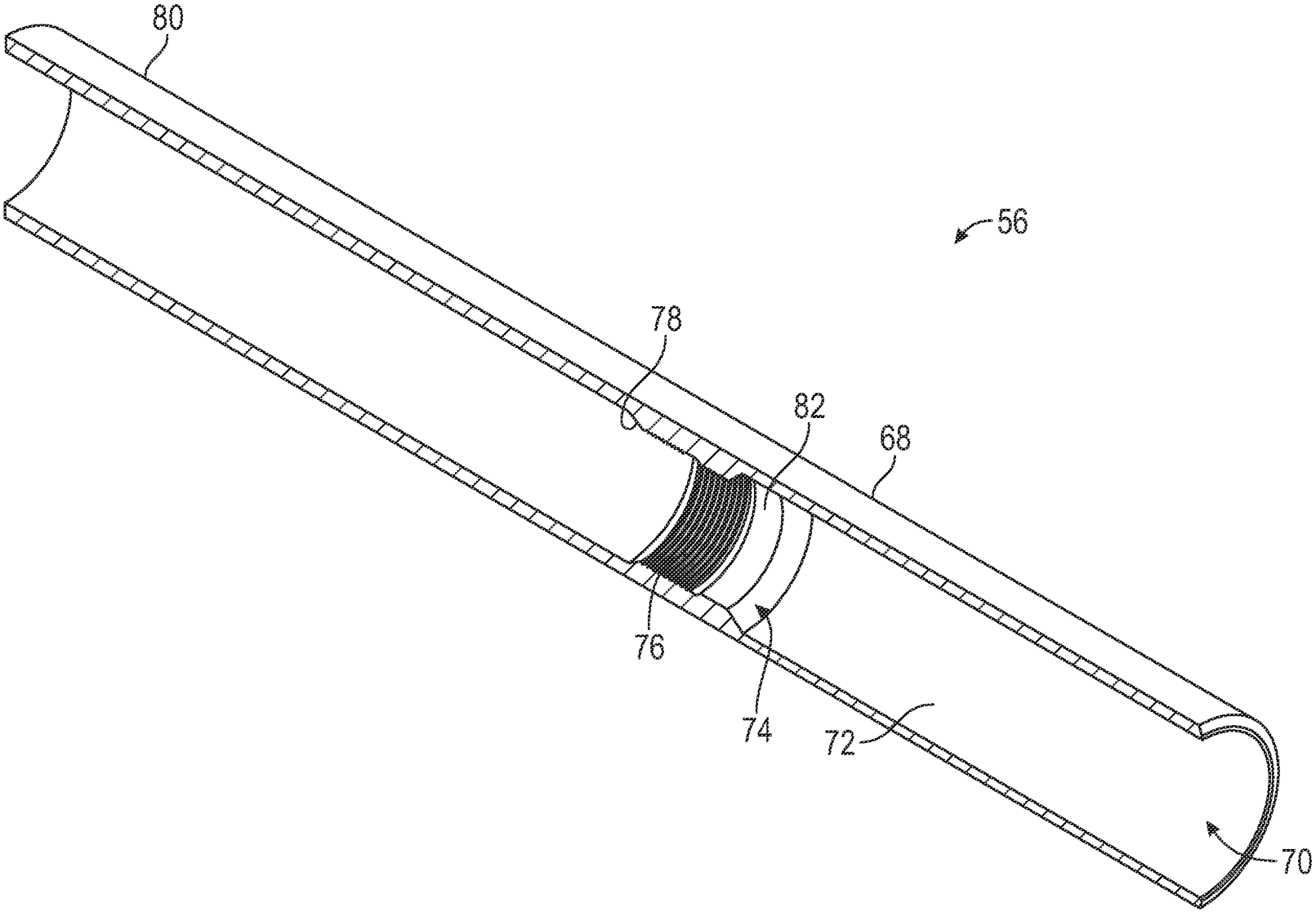
FIG. 2 is a cut-away view of a mating receptacle in accordance with some embodiments of the present disclosure.

FIG. 2 illustrates a mating assembly 56 in accordance with some embodiments. As illustrated, the mating assembly 56 comprises a mating mandrel 68 with a flow passage 70 formed through the mating mandrel 68. The mating mandrel 68 further comprises an inner surface 72 with an internal shoulder 74 formed on the inner surface 72. The inner surface 72 may further comprise a mating engagement surface 76 configured for engagement with a corresponding surface on a tool inserted into the flow passage 70 of the mating mandrel 68. In some embodiments, the engagement may be ratchet-type engagement with the mating engagement surface 76 having teeth, threads, or other features for ratchet-type engagement. In the illustrated embodiment, the mating engagement surface 76 is formed on the internal shoulder 74. As illustrated, the internal shoulder 74 may have a ramped surface 78 facing an uphole end 80 of the mating assembly. The illustrated embodiment, the internal shoulder 74 may be divided into multiple levels. For example, the ramped surface 78 may lead to the first level or the mating engagement surface 76. The internal shoulder 74 may further comprise a second level or downhole stop 82 that extends even further from the inner surface 72 than the mating engagement surface 76.

Figure 3:
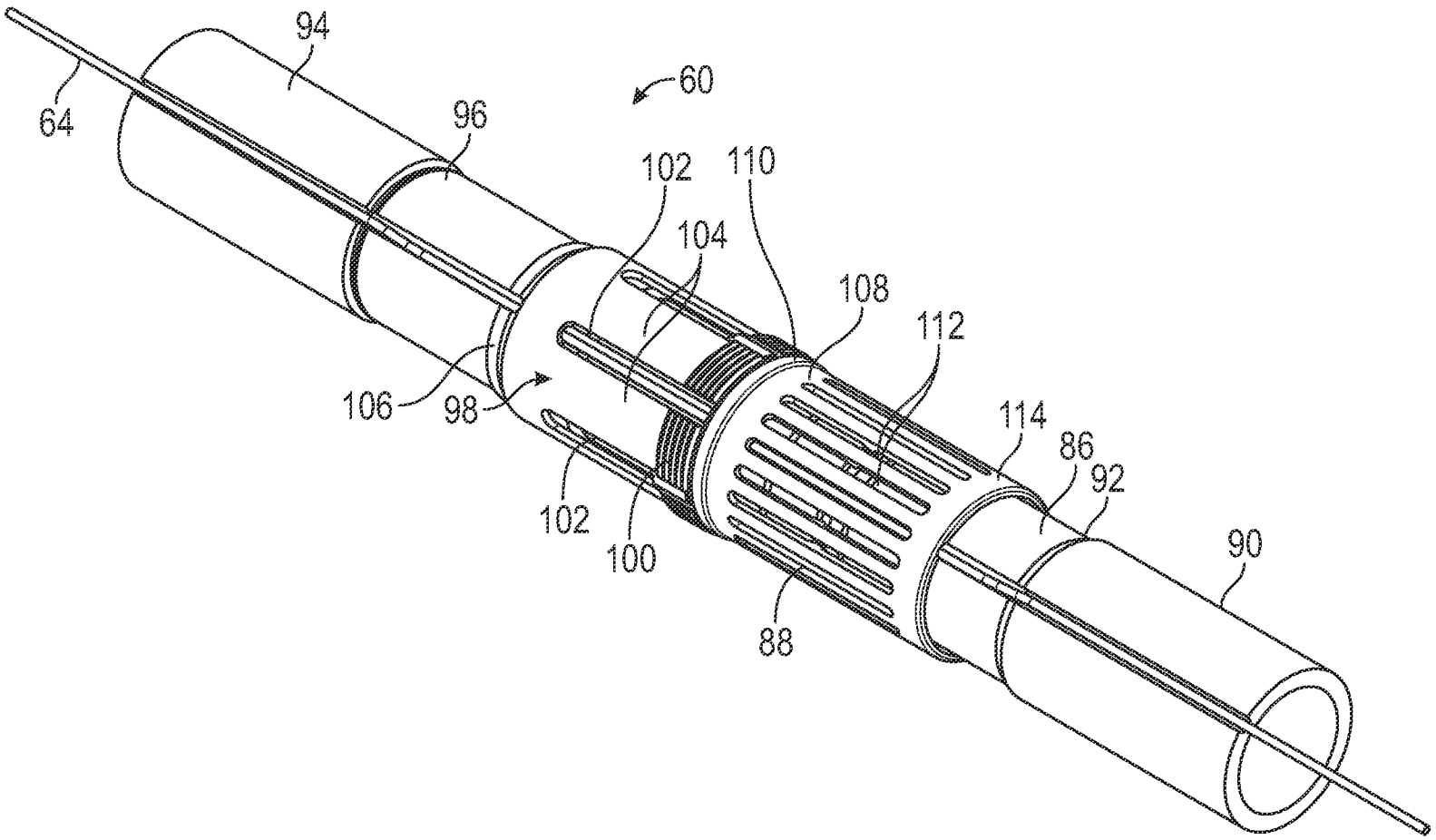
FIG. 3 is an isometric view of a resettable latch in accordance with some embodiments.

FIGS. 3-10 are multiple views of a resettable latch assembly 60 in accordance with some embodiments. FIG. 3 is an isometric view of resettable latch assembly 60 FIGS. 4-10 illustrate the sequence of steps for latching of resettable latch assembly 60 to a mating mandrel 68, releasing resettable latch assembly 60 from mating mandrel 68, and then relatching resettable latch assembly 60 to mating mandrel 68, in accordance with some embodiments.

With reference to FIG. 3, resettable latch assembly 60 is illustrated in accordance with some embodiments. As illustrated, resettable latch assembly 60 comprises a mandrel 86 having a latch collet 98 and a locking collet 88 carried on mandrel 86. As will be discussed in more detail below the latch collet 98 may releasably latch the resettable latch assembly 60 to a downhole tool (e.g., mating mandrel 68 on FIG. 2) while the locking collet 88 locates the downhole tool and limits further downward movement of the resettable latch assembly 60 when located. A first end coupling 90 may be attached to a distal end 92 of the mandrel. A second end coupling 94 may be attached to a proximal end 96 of the mandrel 86. Also illustrated on FIG. 3 is energy transfer line 64. As illustrated, energy transfer line 64 extends along resettable latch assembly 60. The energy transfer line may be carried in a groove on the resettable latch assembly. In some embodiments, the energy transfer line 64 may be attached to an exterior of resettable latch assembly 60. However, the energy transfer line 64 may be otherwise configured, for example, the energy transfer line 64 may be positioned inside resettable latch assembly 60. While only a single energy transfer line 64 is shown, it should be understood that the resettable latch assembly 60 may carry multiple energy transfer lines 64.

The resettable latch assembly 60 comprises a latch collet 98. As illustrated, the latch collet 98 is carried on the mandrel 86 and is disposed about the mandrel 86. The latch collet 98 comprises a collet engagement surface 100 that is used to mate with a corresponding engagement surface (e.g., mating engagement surface 76 on FIG. 2). The collet engagement surface 100 may engage with the corresponding engagement surface in any suitable type of engagement, such as ratchet-latch type. Thus, the collet engagement surface 100 and/or the corresponding engagement surface may comprise teeth (e.g., the collet engagement surface 100 in this embodiment), and the other one of the engagement surfaces may comprise corresponding teeth or a threaded surface (e.g., the mating engagement surface 76 on FIG. 2 in this embodiment). In the illustrated embodiment, the collet engagement surface 100 may be formed on an outer surface at an end of the latch collet 98.

The latch collet 98 may be radially flexible (e.g., radially compressible and/or expandable) with respect to the mandrel 86, for the engagement surfaces to engage and disengage with each other. For example, the latch collet 98 may comprise a plurality of slots 102 to define a plurality of fingers 104 disposed radially around the latch collet 98 with the collet engagement surface 100 formed upon the fingers 104 to facilitate the latch collet 98 flexing or bending with respect to the mandrel 86 (or mating mandrel 68 on FIG. 2). The latch collet 98 may be able to move axially with respect to the mandrel 86. Further, though not necessary, the latch collet 98 may be rotationally constrained with respect to the mandrel 86 such that the latch collet 98 is not able to rotate about or with respect to the mandrel 86. A collet stop 106 may be positioned on the mandrel 86, for example, to limit relative movement of the latch collet 98 and mandrel 86. In some embodiments, the collet stop 106 may be in the form of a snap ring.

Resettable latch assembly 60 also may comprise locking collet 88. As illustrated, the locking collet 88 is carried on the mandrel 86 and is disposed about the mandrel 86. At an uphole end 108, the locking collet 88 comprises a landing shoulder 110. In the illustrated embodiment, locking collet 88 may comprise slots 112, for example, that longitudinally extend between uphole end 108 and downhole end 114 of locking collet. The locking collet 88 may be able to move axially with respect to the mandrel 86, for example, from a locked position to an unlocked position. Further, though not necessary, locking collet 88 may be rotationally constrained with respect to mandrel 86 such that locking collet 88 is not able to rotate about or with respect to mandrel 86. As will be discussed in more detail below, locking collet 88 and/or mandrel 86 may comprise features (e.g., sleeve locking feature 120, mandrel locking feature 122 on FIG. 4) that interact with one another to limit relative translational movement of locking collet 88 and mandrel 86. Longitudinally extending slots 112 may allow flexing of locking collet 88 to allow disengagement of locking collet 88 from mandrel 86.

Figure 4:
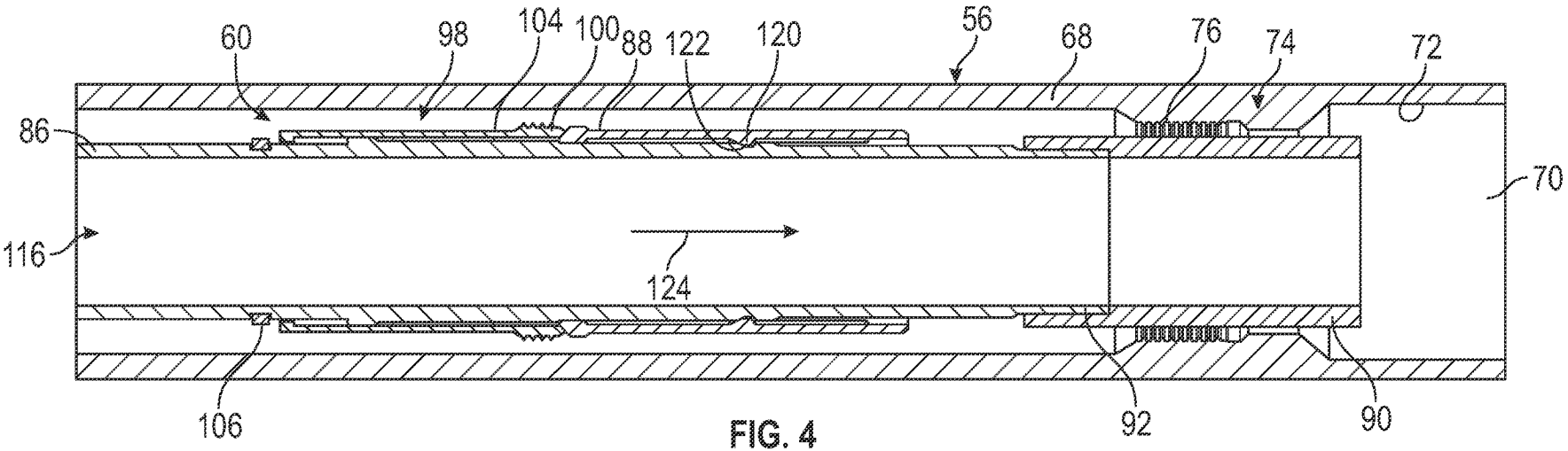
FIG. 4 is a cross-sectional view of the resettable latch assembly of FIG. 3 and a mating receptacle in accordance with some embodiments.

With additional reference to FIG. 4, resettable latch assembly 60 of FIG. 3 is shown positioned in mating assembly 56 of FIG. 2, in accordance with some embodiments. As illustrated, resettable latch assembly 60 has been run into a borehole (e.g., borehole 38 on FIG. 1) and into mating assembly 56 in accordance with some embodiments. In the illustrated embodiment, resettable latch assembly 60 is shown in a run-in configuration. Mating assembly 56 may comprise a mating mandrel 68 with a flow passage 70. Mating mandrel 68 further may comprise an inner surface 72 with an internal shoulder 74, wherein internal shoulder 74 may comprise a mating engagement surface 76 and a downhole stop 82 that extends into flow passage 70 beyond mating engagement surface 76. As illustrated, the resettable latch assembly 60 comprise a mandrel 86 and a locking collet 88 carried on the mandrel 86. Mandrel 86 may have a flow passage 116 that extends longitudinally through the mandrel 86. The illustrated embodiment also shows a first end coupling 90 coupled to a distal end 92 of mandrel 86.

As previously discussed, resettable latch assembly 60 may comprise a latch collet 98. As illustrated, latch collet 98 is carried on mandrel 86 and is disposed about mandrel 86. Latch collet 98 may comprise fingers 104 with collet engagement surface 100 that may be used to mate with mating engagement surface 76 of the mating assembly 56. In the illustrated embodiment, collet stop 106 may be positioned on mandrel 86, for example, to limit relative movement of latch collet 98 and mandrel 86. As illustrated, collet stop 106 may extend radially from mandrel 86.

Resettable latch assembly 60 also may comprise locking collet 88 carried on mandrel 86 and may be disposed about the mandrel 86. In the illustrated embodiment, locking collet 88 comprises sleeve locking feature 120 that interacts with mandrel locking feature 122 to limit axial movement of locking collet 88 with respect to mandrel 86. As shown on FIG. 4, the locking collet 88 may be in a locked position with sleeve locking feature 120 engaging mandrel locking feature 122. In the illustrated embodiment, sleeve locking feature 120 is in the form of an internal projection while mandrel locking feature 122 is in the form of a groove or other retaining feature. However, the sleeve locking feature 120 and mandrel locking feature 122 may be otherwise formed with sleeve locking feature 120 being a groove or other retaining feature with mandrel locking feature 122 being in the form of an external projection. As illustrated, sleeve locking feature 120 may ride in the mandrel locking feature 122 to restrict axial movement.

Figure 5:
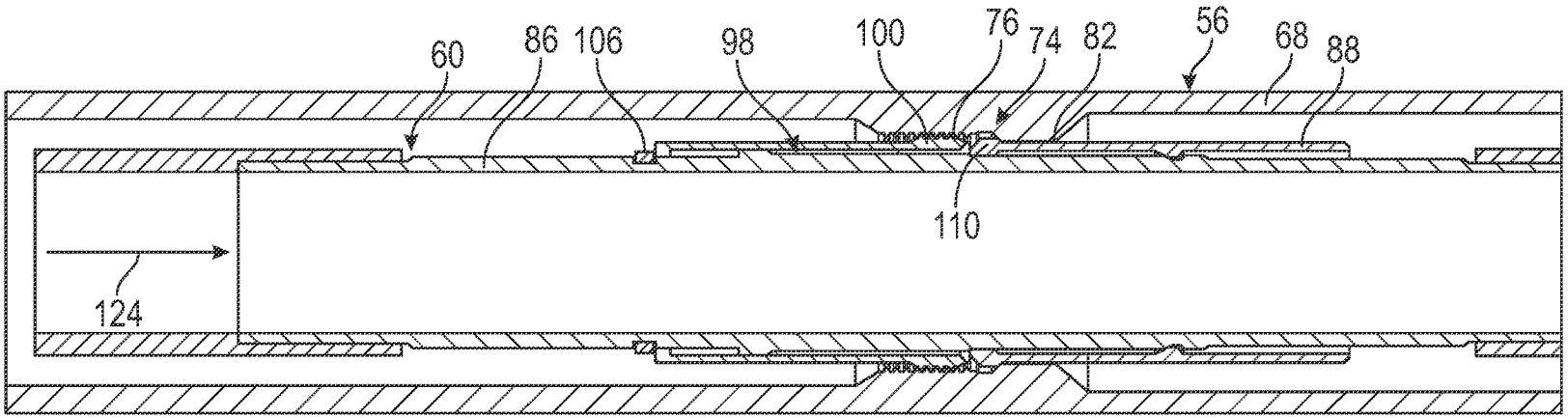
FIG. 5 is a cross-sectional view of the resettable latch assembly of FIG. 3 and a mating receptacle in accordance with some embodiments.

With reference to FIGS. 4-10, the sequence of steps for operating resettable latch assembly 60 to latch with mating assembly 56 will now be described in accordance with some embodiments. As illustrated in FIG. 4, resettable latch assembly 60 may be run into a borehole (e.g., borehole 38 on FIG. 1) and into mating assembly 56 in downhole direction 124. In this run-in configuration, fingers 104 of resettable latch assembly 60 are unsupported so can bend and flex as needed. The sleeve locking feature 120 of locking collet 88 may also be engaged with mandrel locking feature 122 to restrict translation movement of locking collet 88 during run-in. Turning now to FIG. 5, resettable latch assembly 60 is run further into mating assembly 56 in downhole direction 124. When the collet engagement surface 100 of latch collet 98 reaches internal shoulder 74 of mating mandrel 68, for example, compressive force may be applied to allow translational movement of collet engagement surface 100 along mating engagement surface 76. As fingers 104 of the latch collet are unsupported, the collet engagement surface 100 may ratchet up the mating engagement surface 76 of mating mandrel 68. Resettable latch assembly 60 may be run into mating assembly 56 until locking collet 88 engages mating mandrel 68 to limit further movement of resettable latch assembly 60 into mating mandrel 68. In the illustrated embodiment, landing shoulder 110 of locking collet 88 engages downhole stop 82 on mating mandrel 68 to limit further movement into mating mandrel 68. Collet stop 106 engages latch collet 98 to limit translation movement of latch collet 98 along mandrel 86. To latch resettable latch assembly 60, mandrel 86 may be pulled in uphole direction, as shown on FIG. 6. Locking collet 88 rides on mandrel 86, which is being pulled in uphole direction 126 to apply a tensional load, but latch collet 98 remains stationary as it is engagement with mating engagement surface 76 of mating mandrel 68. Locking collet 88 engagement latch collet 98 to lock latch collet 98 to mating mandrel 68. As illustrated, landing shoulder 110 comprise an angled surface 117 that engages fingers 104 to support the fingers 104 preventing them from flexing, thus latching the fingers 104 to the mating mandrel 68. In this position, resettable latch assembly 60 may be considered in a latched position with latch collet 98 latched into mating mandrel 68. Accordingly, resettable latch assembly 60 may be latched into mating mandrel 68. With the resettable latch assembly 60 latched, connection of energy transfer line (e.g., energy transfer line 64) with downhole equipment may be tested. If a desired connection is not found, resettable latch assembly 60 may be released so that another connection may be formed.

Figure 6:
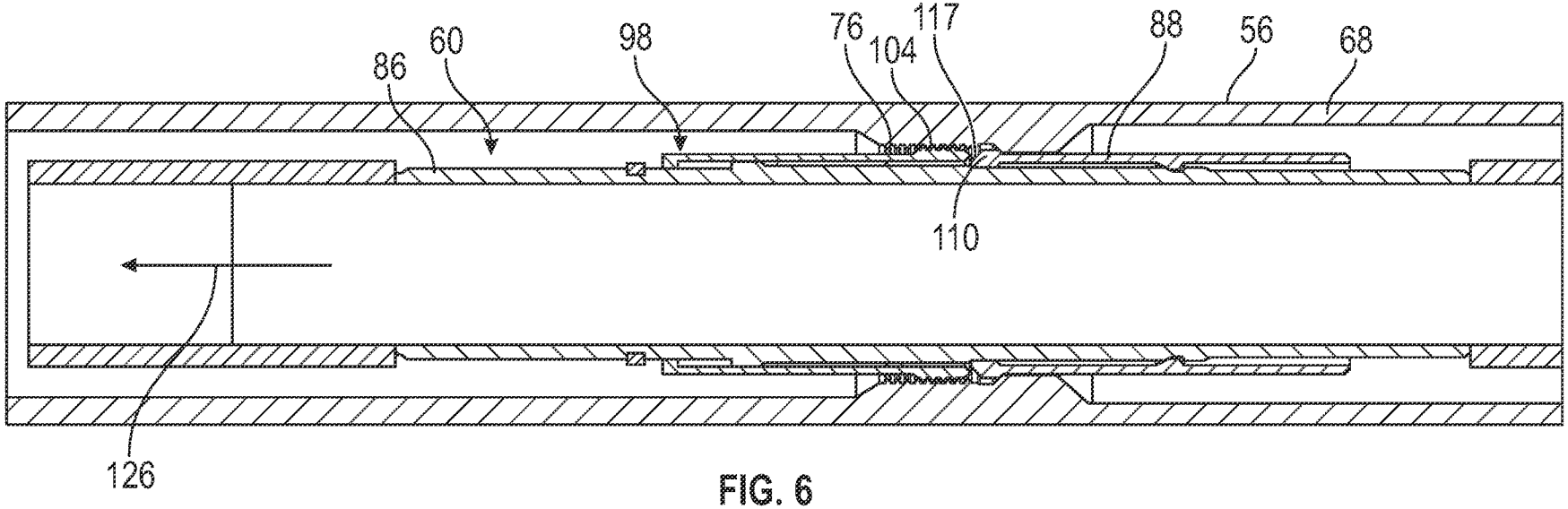
FIG. 6 is a cross-sectional view of the resettable latch assembly of FIG. 3 and a mating receptacle in accordance with some embodiments.
Figure 7:
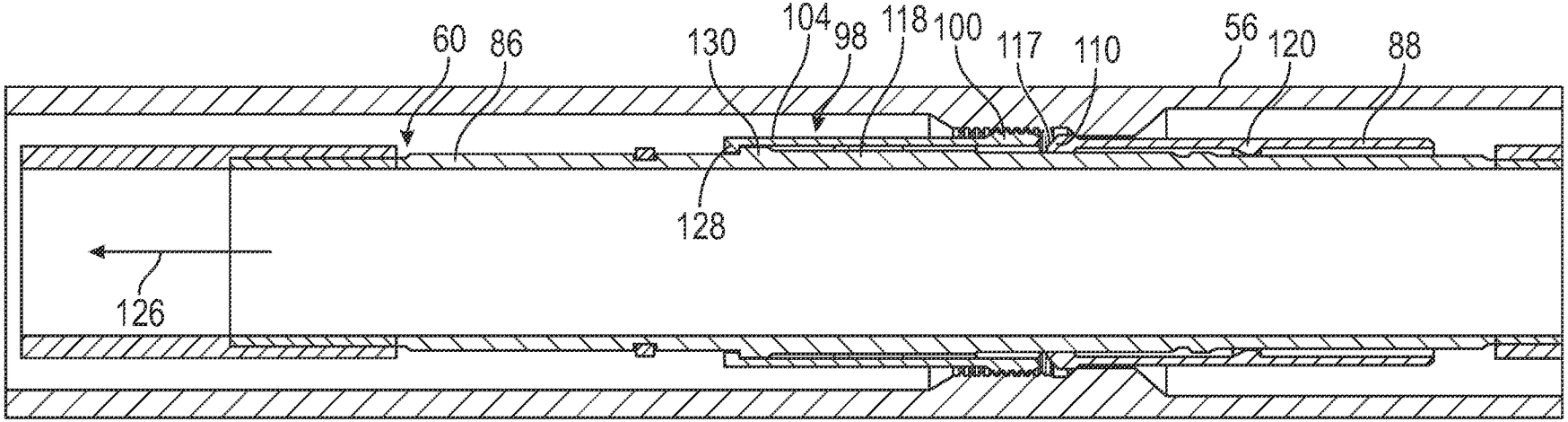
FIG. 7 is a cross-sectional view of the resettable latch assembly of FIG. 3 and a mating receptacle in accordance with some embodiments.
Figure 8:
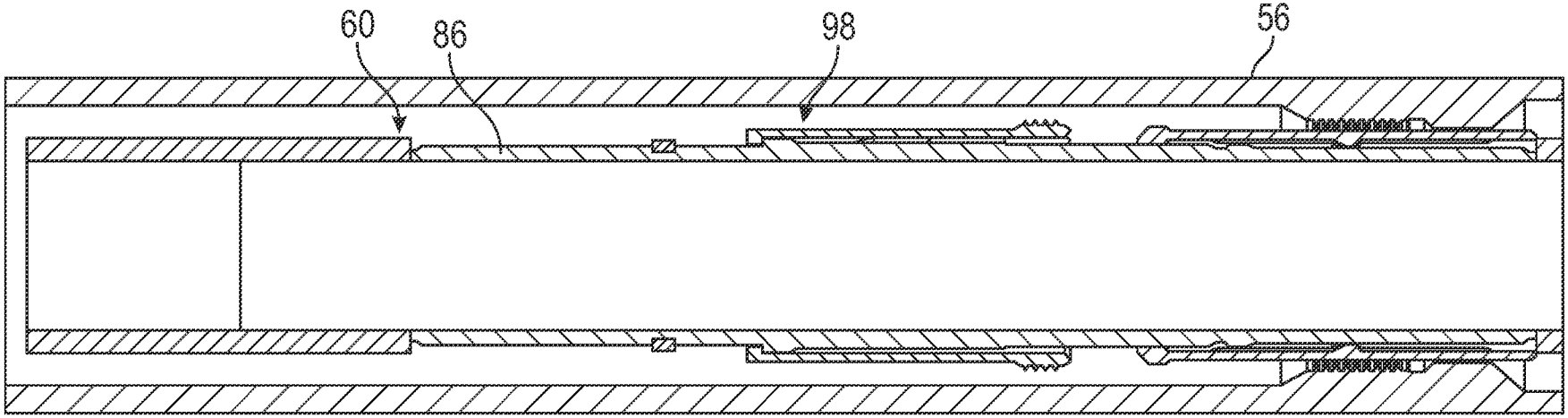
FIG. 8 is a cross-sectional view of the resettable latch assembly of FIG. 3 and a mating receptacle in accordance with some embodiments.

With reference to FIGS. 6-8, release of resettable latch assembly 60 from mating assembly 56 will now be described in accordance with some embodiments. As shown on FIG. 6, resettable latch assembly 60 may be pulled in an uphole direction as shown by arrow 126, which should apply a tension load on resettable latch assembly 60. Locking collet 88 rides on mandrel 86, which is being pulled in uphole direction 126, but latch collet 98 is latched to mating mandrel 68. This tension load may be applied to release releasable latching assembly 60, which loads load landing shoulder 110 of locking collet 88 on latch collet 98 until locking collet 88 disengages from mandrel 86, as shown on FIG. 7. For example, locking collet 88 may flex to allow sleeve locking feature 120 to disengage from mandrel locking feature 122. With locking collet 88 disengaged and in an unlocked position, locking collet 88 may slide down mandrel such that angled surface 117 is not supporting fingers 104 of latch collet 98 at collet engagement surface 100. Without this support, fingers 104 can flex inward to mandrel 86. Resettable latch assembly 60 may be considered in a latched position with latch collet 98 latched into mating mandrel 68. Mandrel 86 engages latch collet 98 so that mandrel 86 and latch collet 98 are pulled in uphole direction 126. For example, external shoulder 130 of mandrel 86 engaging internal shoulder 128 of latch collet 98. As resettable latch assembly 60 with mandrel 86 and latch collet 98 is pulled in uphole direction 126 with collet engagement surface 100 unsupported by mandrel 86, resettable latch assembly 60 releases from mating mandrel 68, as shown on FIG. 8. With resettable latch assembly 60 released, resettable latch assembly 60 can be retrieved from borehole (e.g., borehole 38 on FIG. 1) or reset with downward movement.

Figure 9:
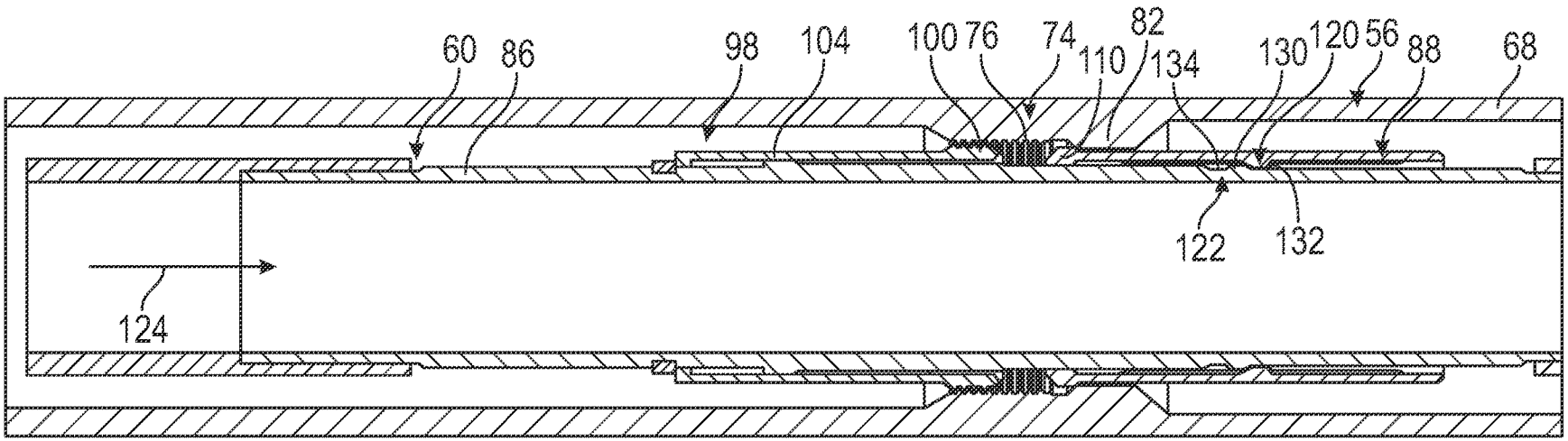
FIG. 9 is a cross-sectional view of the resettable latch assembly of FIG. 3 and a mating receptacle in accordance with some embodiments.
Figure 10:
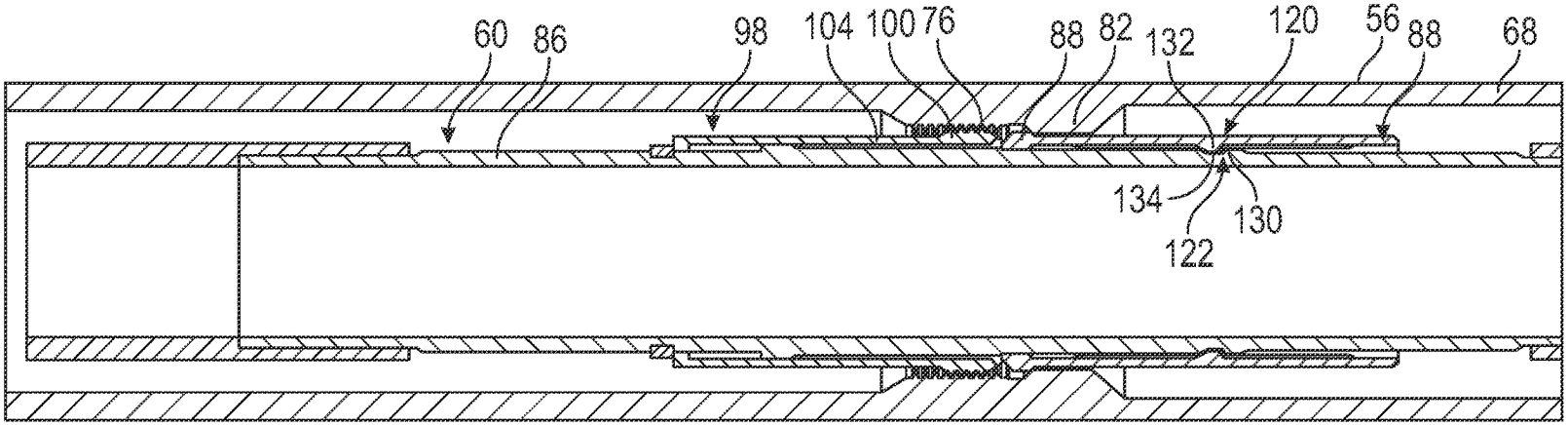
FIG. 10 is a cross-sectional view of the resettable latch assembly of FIG. 3 and a mating receptacle in accordance with some embodiments.

Turning now to FIG. 9, resettable latch assembly 60 may be re-run further into mating assembly 56 in downhole direction 124, to reset latch collet 98, in accordance with some embodiments. As illustrated resettable latch assembly 60 may be run into mating assembly 56 such that latch collet 98 may be latched into mating mandrel 68. When the collet engagement surface 100 of latch collet 98 reaches internal shoulder 74 of mating mandrel 68, for example, compressive force may be applied to allow translational movement of collet engagement surface 100 along mating engagement surface 76. Collet engagement surface 100 contacts and engages mating engagement surface 76 to hold mandrel 86. As fingers 104 of the latch collet are unsupported, the collet engagement surface 100 may ratchet up the mating engagement surface 76 of mating mandrel 68. Resettable latch assembly 60 may be run into mating assembly 56 until locking collet 88 engages mating mandrel 68 to limit movement of locking collet 88 in downhole direction 124. For example, landing shoulder 110 of locking collet 88 lands on downhole stop 82 to limit further movement of locking collet in downhole direction 124. As illustrated, sleeve locking feature 120 of locking collet 88 is not engaged with mandrel locking feature 122 so mandrel 86 with resettable latch assembly 60 can continue to move in downhole direction 124. Mandrel locking feature 122 on mandrel 86 comprises a mandrel external shoulder 130 and a mandrel external groove 134. Mandrel 86 is moved in downhole direction until mandrel external shoulder 130 engages a corresponding sleeve internal shoulder 132 of sleeve locking feature 120. Compressive load may be applied to mandrel 86 for locking collet 88 to flex allowing sleeve internal shoulder 132 to pop over mandrel external shoulder 130 such that sleeve internal shoulder 132 is landed in mandrel external groove 134, as shown on FIG. 10. Accordingly, sleeve locking feature 120 may then be engaged to mandrel locking feature 122, thus locking collet 88 onto mandrel 86. Because landing shoulder 110 of locking collet 88 may be landed on downhole stop 82 of mating mandrel 68, further movement of resettable latch assembly 60 with mandrel 86, resettable latch assembly 60, and locking collet 88 may be restricted. As illustrated, resettable latch assembly 60 may be latched into mating mandrel 68 of mating assembly 56 with collet engagement surface 100 secured into mating engagement surface 76, thus limiting translational movement of resettable latch assembly 60.

Accordingly, FIGS. 4-10 illustrate the sequence of steps for latching, releasing, and relatching of resettable latch assembly 60 into mating assembly 56 in accordance with some embodiments. This sequence of steps can be repeated as many times as necessary for operation without needing to trip resettable latch assembly 60 of out of a borehole (e.g., borehole 38 on FIG. 1). For example, this sequency may be repeated multiple times to confirm a desirable connection has been obtained, for example, between energy transfer line (e.g., energy transfer line 64 on FIG. 3) and downhole equipment energy transfer line (e.g., downhole energy transfer line 58 on FIG. 1).

Figure 11:
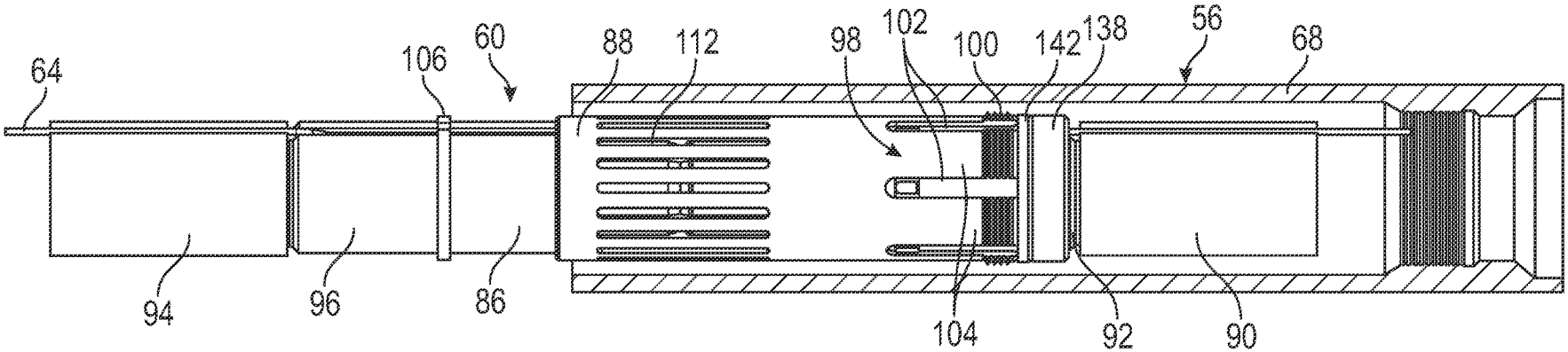
FIG. 11 is a side, cutaway view of the mating assembly and resettable latch assembly in accordance with some embodiments.

FIGS. 11-16 are multiple views of an alternative embodiment of a resettable latch assembly 60 in accordance with some embodiments. FIG. 11 illustrates resettable latch assembly 60 partially disposed in mating assembly 56. FIGS. 12-16 illustrate the sequence of steps for latching resettable latch assembly 60 to a mating mandrel 68 with the latch collet 98, releasing resettable latch assembly 60 from mating mandrel 68, and then relatching resettable latch assembly 60 to mating mandrel 68, in accordance with some embodiments.

With reference to FIG. 11, the resettable latch assembly 60 is illustrated in accordance with some embodiments. As illustrated, the resettable latch assembly 60 comprises a mandrel 86 having a latch collet 98 on mandrel 86. The resettable latch assembly 60 may also comprise a locking collet 88. As will be discussed in more detail below the latch collet 98 may releasably latch the resettable latch assembly 60 to a downhole tool (e.g., mating mandrel 68) while the locking collet 88 fixes resettable latch assembly 60 to mandrel 86. A locator ring 138 may also be carried on mandrel 86 downhole from latch collet 98. A first end coupling 90 may be attached to a distal end 92 of the mandrel. A second end coupling 94 may be attached to a proximal end 96 of the mandrel 86. Also illustrated on FIG. 11 is energy transfer line 64. As illustrated, energy transfer line 64 extends along resettable latch assembly 60. In some embodiments, the energy transfer line 64 may be attached to an exterior of resettable latch assembly 60. For example, the energy transfer line 64 may be carried in a groove on the resettable latch assembly 60. However, the energy transfer line 64 may be otherwise configured, for example, the energy transfer line may be positioned inside resettable latch assembly 60. While only a single energy transfer line 64 is shown, it should be understood that the resettable latch assembly 60 may carry multiple energy transfer lines 64.

Resettable latch assembly 60 comprises latch collet 98. As illustrated, latch collet 98 is carried on mandrel 86 and is disposed about mandrel 86. Latch collet 98 comprises a collet engagement surface 100 that is used to mate with a corresponding engagement surface (e.g., mating engagement surface 76 on FIG. 2). Collet engagement surface 100 may engage with the corresponding engagement surface in any suitable type of engagement, such as ratchet-latch type. Thus, collet engagement surface 100 and/or the corresponding engagement surface may comprise teeth (e.g., collet engagement surface 100 in this embodiment), and the other one of the engagement surfaces may comprise corresponding teeth or a threaded surface (e.g., mating engagement surface 76 on FIG. 2 in this embodiment). In the illustrated embodiment, collet engagement surface 100 may be formed on an outer surface at an end of latch collet 98.

Latch collet 98 may be radially flexible (e.g., radially compressible and/or expandable) with respect to the mandrel 86, for the engagement surfaces to engage and disengage with each other. For example, latch collet 98 may comprise a plurality of slots 102 to define a plurality of fingers 104 disposed radially around latch collet 98 with collet engagement surface 100 formed upon fingers 104 to facilitate latch collet 98 flexing or bending with respect to mandrel 86 (or mating mandrel 68). Latch collet 98 may be able to move axially with respect to mandrel 86. Further, though not necessary, latch collet 98 may be rotationally constrained with respect to mandrel 86 such that latch collet 98 is not able to rotate about or with respect to mandrel 86. A collet stop 106 may be positioned on mandrel 86, for example, to limit relative movement of resettable latch assembly 60 (and thus latch collet 98) and mandrel 86. In some embodiments, collet stop 106 may be in the form of a snap ring.

Resettable latch assembly 60 also may comprise locking collet 88. As illustrated, the locking collet 88 is carried on the mandrel 86 and is disposed about the mandrel 86. Locking collet 88 may be positioned uphole from latch collet 98. While locking collet 88 and latch collet 98 are shown as a single, unitary member, they be formed as separate components in other embodiments (not illustrated). In some embodiments, the locking collet 88 may be in the form of a collet with slots 112 formed therein. In the illustrated embodiment, slots 112 may be longitudinally extending. The locking collet 88 (and thus latch collet 98 also) may be able to move axially with respect to the mandrel 86. Further, though not necessary, locking collet 88 may be rotationally constrained with respect to mandrel 86 such that locking collet 88 is not able to rotate about or with respect to mandrel 86. As will be discussed in more detail below, locking collet 88 and/or mandrel 86 may comprise features (e.g., collet shoulder 144, first mandrel groove 146, second mandrel groove 148) that interact with one another to limit relative translational movement of locking collet 88 and mandrel 86. Slots 112 may allow flexing of locking collet 88 to allow disengagement of locking collet 88 from mandrel 86.

Resettable latch assembly 60 also may comprise locator ring 138. As illustrated, locator ring 138 may be carried on mandrel 86 downhole from latch collet 98. Locator ring 138 may comprise a landing shoulder 142.

Figure 12:
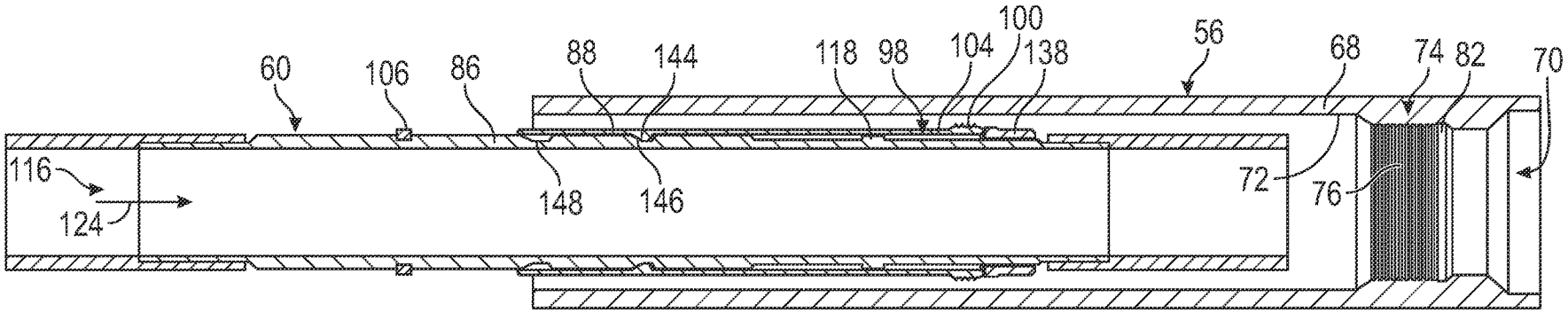
FIG. 12 is a cross-sectional view of a mating assembly and resettable latch assembly in accordance with some embodiments.

With additional reference to FIG. 12, resettable latch assembly 60 of FIG. 3 is shown positioned in mating assembly 56 of FIG. 2, in accordance with some embodiments. Mating assembly 56 may comprise a mating mandrel 68 with a flow passage 70. Mating mandrel 68 further may comprise an inner surface 72 with an internal shoulder 74, wherein internal shoulder 74 may comprise a mating engagement surface 76 and a downhole stop 82 that extends into flow passage 70 beyond mating engagement surface 76. As illustrated, resettable latch assembly 60 may comprise a mandrel 86 having latch collet 98, locking collet 88, and locator ring 138 carried on the mandrel 86. Mandrel 86 may have a flow passage 116 that extends longitudinally through the mandrel 86. The illustrated embodiment also shows a first end coupling 90 and second end coupling 94 coupled to a distal end 92 and proximal end 96, respectively, of mandrel 86.

As previously discussed, resettable latch assembly 60 may comprise a latch collet 98. As illustrated, latch collet 98 is carried on mandrel 86 and is disposed about mandrel 86. Latch collet 98 may comprise fingers 104 with collet engagement surface 100 that may be used to mate with a corresponding surface of mating assembly 56 (e.g., mating engagement surface 76 of the mating assembly 56 shown on FIG. 2). In the illustrated embodiment, collet stop 106 may be positioned on mandrel 86, for example, to limit relative movement of latch collet 98 and mandrel 86. As illustrated, collet stop 106 may extend radially from mandrel 86. In the illustrated embodiment, mandrel 86 may comprise one or more latch support features to extend latch collet 98 from mandrel. For example, mandrel 86 may comprise radial extension 118 that can hold and support fingers 104 (when positioned underneath) with collet engagement surface 100 preventing them from deflecting radially inward to mandrel 86. Radial extension 118 may integrally formed with mandrel 86 or may be a separate component positioned on mandrel 86 that supports fingers 104.

Resettable latch assembly 60 also may comprise locking collet 88 carried on mandrel 86 and may be disposed about the mandrel 86. In the illustrated embodiment, locking collet 88 comprises one or more sleeve locking features (e.g., collet shoulder 144) that interacts with mandrel locking features (e.g., first and second mandrel grooves 146, 148) to limit axial movement of locking collet 88 and thus latch collet 98 with respect to resettable latch assembly 60. In the illustrated embodiment, collet shoulder 144 can ride one of first and second mandrel grooves 146, 148 to lock locking collet 88 and thus latch collet 98 on mandrel 68.

Figure 13:
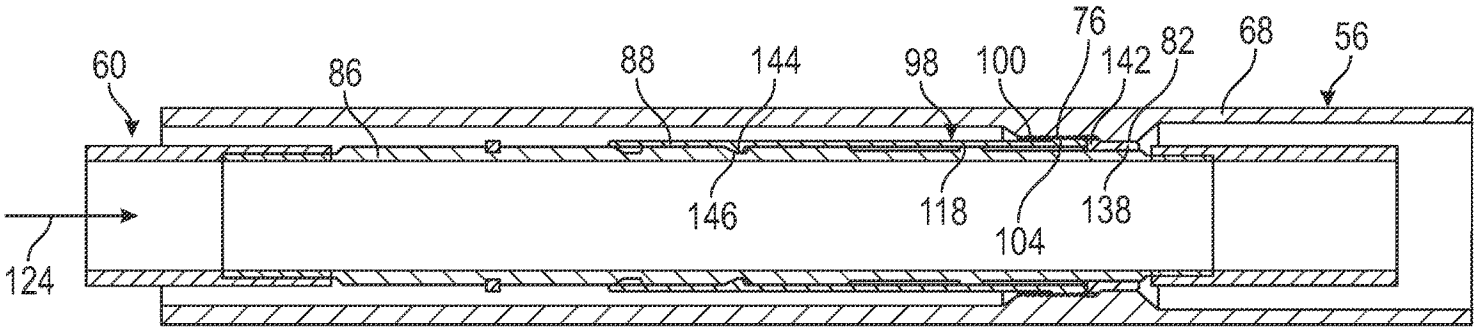
FIG. 13 is a cross-sectional view of the mating assembly and resettable latch assembly of FIG. 11 in accordance with some embodiments.
Figure 14:
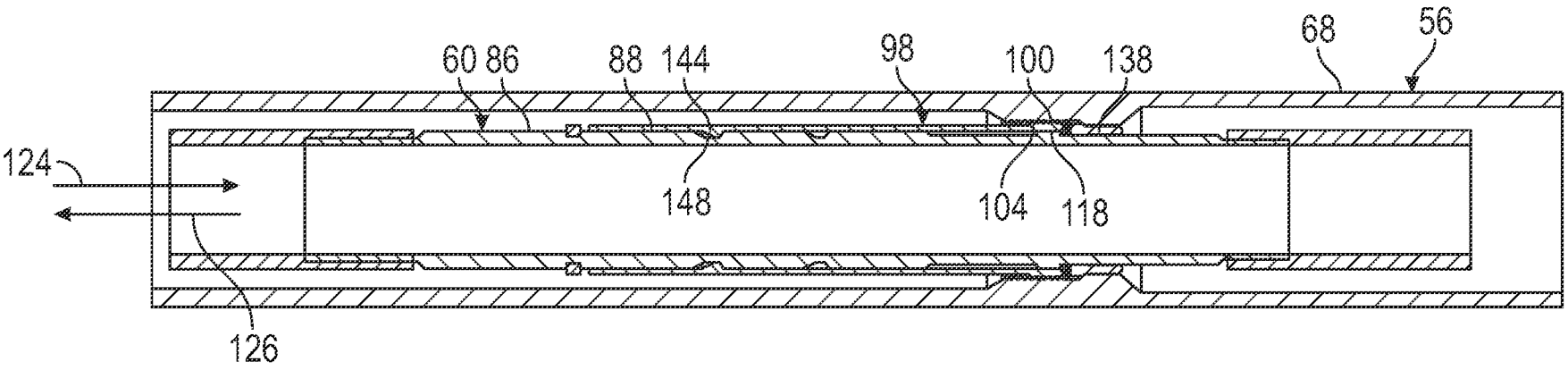
FIG. 14 is a cross-sectional view of the mating assembly and resettable latch assembly of FIG. 11 in accordance with some embodiments.

With reference to FIGS. 12-16, the sequence of steps for operating resettable latch assembly 60 to latch with mating assembly 56 will now be described in accordance with some embodiments. As illustrated in FIG. 12, resettable latch assembly 60 may be run into a borehole (e.g., borehole 38 on FIG. 1) and into mating assembly 56 in downhole direction 124. In this run-in configuration, radial extension 118 of mandrel 86 does not support the fingers 104 of resettable latch assembly 60, such that fingers 104 are free to flex inward toward mandrel 86. The sleeve locking feature (e.g., collet shoulder 144) may also be engaged with a corresponding mandrel locking feature (e.g., first mandrel groove 146). As illustrated, collet shoulder 144 may ride in first mandrel groove 146 to lock locking collet 88 onto mandrel 86, thus restricting translational movement of locking collet 88 and latch collet 98 during run-in. Turning now to FIG. 13, resettable latch assembly 60 is run further into mating assembly 56 in downhole direction 124. As illustrated, resettable latch assembly 60 may run into mating mandrel 68 of mating assembly 56 until locator ring 138 on mandrel 68 lands on mating mandrel 68. For example, landing shoulder 142 of locator ring 138 may land on downhole stop 82 of mating mandrel 68. In the illustrated embodiment, collet engagement surface 100 of latch collet 98 is engaged with mating engagement surface 76 of mating mandrel 68. However, resettable latch assembly 60 not be considered latched to mating mandrel 68 as radial extension 118 of mandrel 86 is not positioned behind fingers 104 at collet engagement surface 100. With application of force to resettable latch assembly 60 with locator ring 138 landed on mating mandrel 68, locking collet 88 may be come disengaged from mandrel 86. For example, force may be applied to resettable latch assembly 60 in the downhole direction 124 until locking collet 88 disengages from mandrel 86. More specifically, locking collet 88 may flex to allow collet shoulder 144 to disengage from first mandrel groove 146, thus allowing locking collet 88 and latch collet 98 to move axially with respect to mandrel 86. As shown in FIG. 14, resettable latch assembly 60 with mandrel 86 may be further run in downhole direction 124. However, because locator ring 138 may be landed on mating mandrel 68 limiting downward movement of resettable latch assembly 60, mandrel 86 may move downhole with respect to locking collet 88 and latch collet 98. As shown on FIG. 14, mandrel 86 may move downhole until mandrel 86 is positioned such that collet shoulder 144 of locking collet 88 is now disposed in second mandrel groove 148, thus securing locking collet 88 to mandrel 86. In addition, resettable latch assembly 60 may be considered in a latched configuration with radial extension 118 of mandrel 86 positioned behind fingers 104 at collet engagement surface 100. This limits movement of fingers 104 inward to mandrel 86, latching resettable latch assembly 60 to mating assembly 56.

Figure 15:
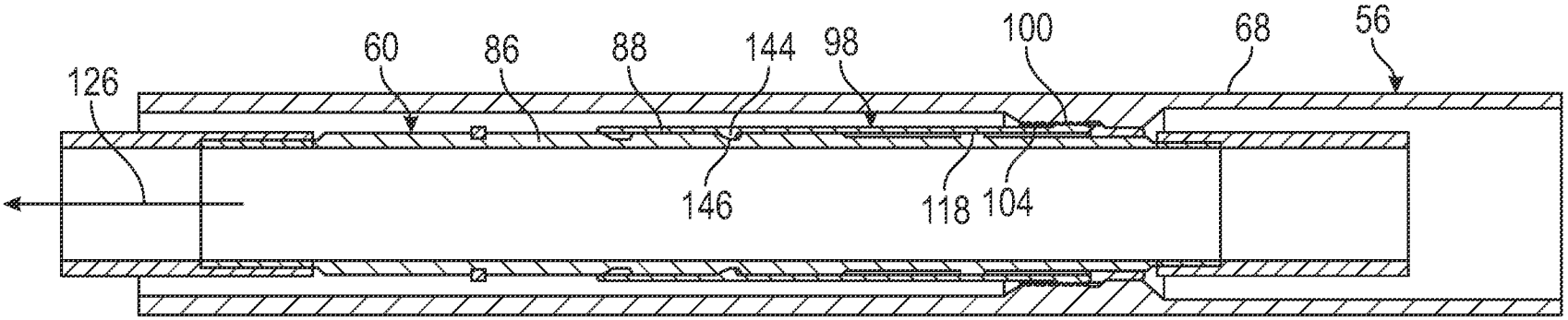
FIG. 15 is a cross-sectional view of the mating assembly and resettable latch assembly of FIG. 11 in accordance with some embodiments.
Figure 16:
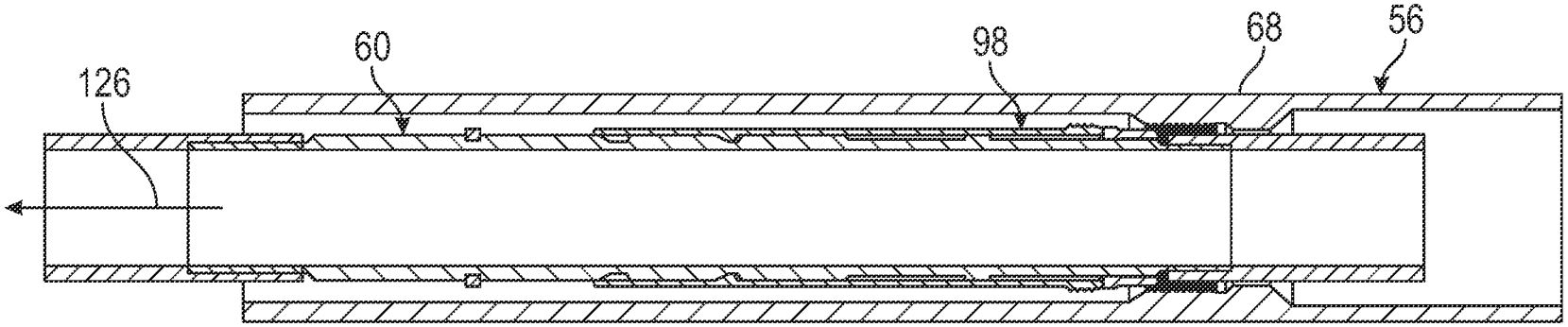
FIG. 16 is a cross-sectional view of the mating assembly and resettable latch assembly of FIG. 11 in accordance with some embodiments.

With reference to FIGS. 14-16, release of resettable latch assembly 60 from mating assembly 56 will now be described in accordance with some embodiments. As shown on FIG. 14, resettable latch assembly 60 may be pulled in an uphole direction as shown by arrow 126, which should apply a tension load on resettable latch assembly 60. Load may be applied to resettable latch assembly 60 in uphole direction 126, but resettable latch assembly 60 is latched into mating assembly 56 with radial extension 118 positioned behind fingers 104. Locking collet 88 and latch collet 98 are also locked onto mandrel 86 with collet shoulder 144 engaged in second mandrel groove 148. By pulling resettable latch assembly 60 in the uphole direction 126, this tension load may be applied to release locking collet 88 and thus latch collet 98 from mandrel 86. For example, pulling the resettable latch assembly 60 in uphole direction should load collet shoulder 144 until locking collet 88 disengages from mandrel 86. For example, locking collet 88 may flex to allow collet shoulder 144 to disengage from second mandrel groove 148. With locking collet 88 disengaged, mandrel 86 may move in uphole direction 126. With reference now to FIG. 14, mandrel 86 may move in uphole direction 126 until collet shoulder 144 engages with first mandrel groove 146 thus again locking resettable latch assembly 60 to mandrel 86. In addition, by moving in uphole direction 126, mandrel 86 may move such that radial extension 118 is not supporting fingers 104 of latch collet 98 at collet engagement surface 100. Without this support, fingers 104 can flex inward to mandrel 86 such that resettable latch assembly 60 is not latched to mating assembly 56. With locking collet 88 engaged on mandrel 86 and resettable latch assembly 60 released from mating assembly 56, resettable latch assembly 60 may be pulled further in uphole direction 126, as shown on FIG. 16. With resettable latch assembly 60 released, resettable latch assembly 60 can be retrieved from borehole (e.g., borehole 38 on FIG. 1) or reset with downward movement. For example, resettable latch assembly 60 is in its run-in configuration and can be reset and latched into mating mandrel 68 with downward movement.

Accordingly, FIGS. 12-16 illustrate the sequence of steps for latching, releasing, and relatching of resettable latch assembly 60 into mating assembly 56 with latch collet 98 in accordance with some embodiments. This sequence of steps can be repeated as many times as necessary for operation without needing to trip resettable latch assembly 60 of out of a borehole (e.g., borehole 38 on FIG. 1). For example, this sequency may be repeated multiple times to confirm a desirable connection has been obtained, for example, between energy transfer line (e.g., energy transfer line 64 on FIG. 11) and downhole equipment.

Figure 17:
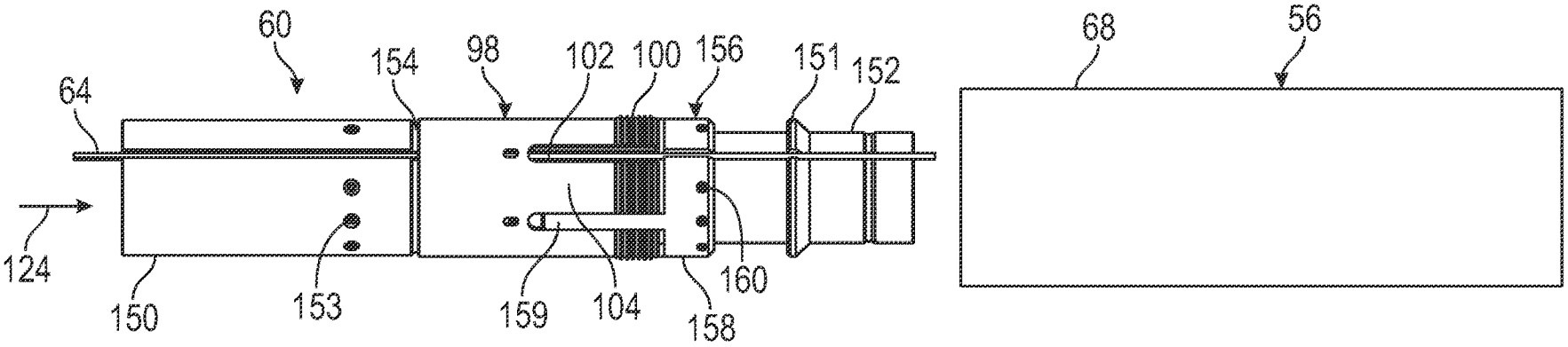
FIG. 17 is a side view of another resettable latch assembly with an energy transfer line in accordance with some embodiments.

FIGS. 17-22 are multiple views of an alternative embodiment of a resettable latch assembly 60 in accordance with some embodiments. FIG. 17 illustrates resettable latch assembly 60 in a run-in configuration before positioning in mating assembly 56. FIGS. 18-22 illustrate the additional steps for latching resettable latch assembly 60 to a mating mandrel 68 of mating assembly 56 with latch collet 98, releasing resettable latch assembly 60 from mating mandrel 68, and then relatching resettable latch assembly 60 to mating mandrel 68, in accordance with some embodiments.

With reference to FIG. 17, resettable latch assembly 60 is illustrated in accordance with some embodiments. As illustrated, resettable latch assembly 60 comprises an upper mandrel 150 and a lower mandrel 152 attached to one another. Upper shear members 153 may secure the upper mandrel 150 to lower mandrel 152. Resettable latch assembly 60 may also comprise a latch collet 98 on lower mandrel 152. Upper shear members 153 may be any suitable shearing members that shears upon application of a predetermined force, including shear pins, shear screws, shear rings, and shear bolts, among others. As will be discussed in more detail below the latch collet 98 may releasably latch the resettable latch assembly 60 to a downhole tool (e.g., mating mandrel 68). Resettable latch assembly 60 may further comprise a latch mandrel 154 disposed on lower mandrel 152 between latch collet 98 and lower mandrel 152. A sleeve 156 having collar 158 may also be carried on lower mandrel 152 below latch mandrel 154. Sleeve 156 may have an extension 159 that extends from collar 158 underneath latch collet 98. Lower shear members 160 may secure sleeve 156 to lower mandrel 152. Lower shear members 160 may be any suitable shearing members that shears upon application of a predetermined force, including shear pins, shear screws, rings, and shear bolts, among others. Lower mandrel 152 may comprise a landing shoulder 151 below sleeve 156. Also illustrated on FIG. 17 is energy transfer line 64. As illustrated, energy transfer line 64 extends along resettable latch assembly 60. In some embodiments, the energy transfer line 64 may be attached to an exterior of resettable latch assembly 60. For example, the energy transfer line 64 may be carried in a groove on the resettable latch assembly 60. However, the energy transfer line 64 may be otherwise configured, for example, the energy transfer line may be positioned inside resettable latch assembly 60. While only a single energy transfer line 64 is shown, it should be understood that the resettable latch assembly 60 may carry multiple energy transfer lines 64.

Resettable latch assembly 60 may comprise latch collet 98. As illustrated, latch collet 98 may be carried on lower mandrel 152 and may be disposed about lower mandrel 152. Latch collet 98 may comprise a collet engagement surface 100 that may be used to mate with a corresponding engagement surface (e.g., mating engagement surface 76 on FIG. 2). Collet engagement surface 100 may engage with the corresponding engagement surface in any suitable type of engagement, such as ratchet-latch type. Thus, collet engagement surface 100 and/or the corresponding engagement surface may comprise teeth (e.g., collet engagement surface 100 in this embodiment), and the other one of the engagement surfaces may comprise corresponding teeth or a threaded surface (e.g., mating engagement surface 76 on FIG. 2 in this embodiment). In the illustrated embodiment, collet engagement surface 100 may be formed on an outer surface at an end of latch collet 98.

Latch collet 98 may be radially flexible (e.g., radially compressible and/or expandable) with respect to the mandrel 86, for the engagement surfaces to engage and disengage with each other. For example, latch collet 98 may comprise a plurality of slots 102 to define a plurality of fingers 104 disposed radially around latch collet 98 with collet engagement surface 100 formed upon fingers 104 to facilitate latch collet 98 flexing or bending with respect to lower mandrel 152 (or mating mandrel 68). Latch collet 98 may be able to move axially with respect to lower mandrel 152. Further, though not necessary, latch collet 98 may be rotationally constrained with respect to lower mandrel 152 such that latch collet 98 is not able to rotate about or with respect to lower mandrel 152. Collar 158 of sleeve 156 may be positioned on lower mandrel 152 to limit relative movement of resettable latch assembly 60 (and thus latch collet 98) and lower mandrel 152. As illustrated, collar 158 may engage latch collet 98 to prevent its downward movement on lower mandrel 152.

Resettable latch assembly 60 also may comprise latch mandrel 154. As illustrated, latch mandrel 154 may be carried on lower mandrel 152 and may be disposed about lower mandrel 152. Latch mandrel 154 may be coupled to upper mandrel 150, for example, with a threaded connection. Latch mandrel 154 may extend at least partially under latch collet 98. Latch collet 98 may slide longitudinally on latch mandrel 154. Latch mandrel 154 may be initially positioned as shown on FIG. 17, for example, during run-in, in a position that does not support fingers 104 of latch collet 98.

Figure 18:
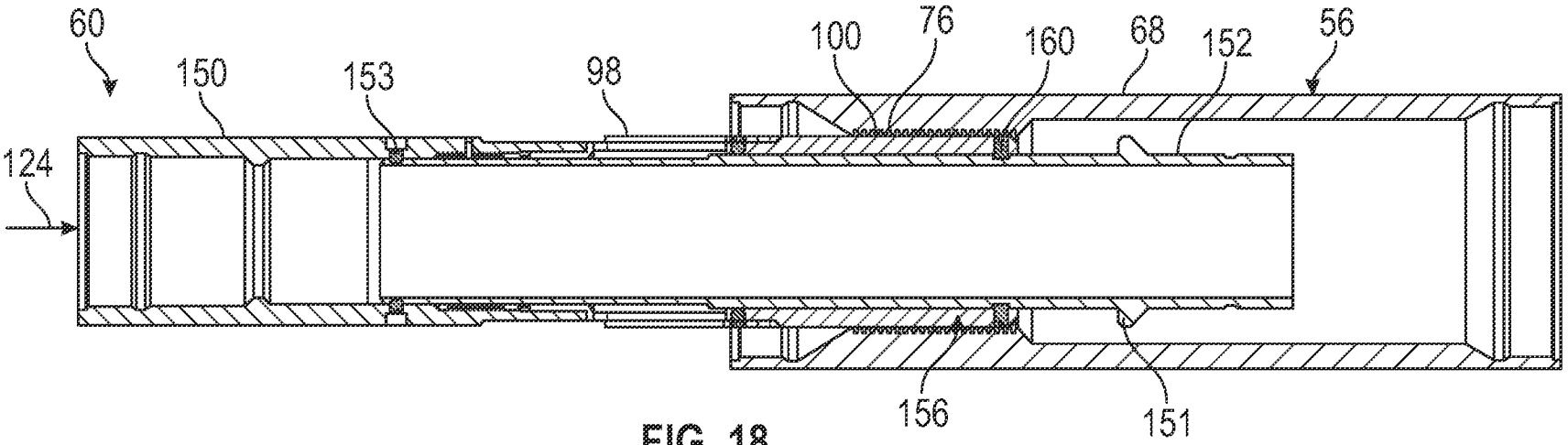
FIG. 18 is a cross-sectional view of the resettable latch assembly of FIG. 17 and a mating receptacle in accordance with some embodiments.

With reference to FIGS. 17-22, the sequence of steps for operating resettable latch assembly 60 to latch with mating assembly 56 will now be described in accordance with some embodiments. As illustrated in FIG. 17, resettable latch assembly 60 may be run into a borehole (e.g., borehole 38 on FIG. 1) and into mating assembly 56 in downhole direction 124. In this run-in configuration, latch mandrel 154 does not support the fingers 104 of resettable latch assembly 60, such that fingers 104 are free to flex inward toward lower mandrel 152. Turning now to FIG. 18, resettable latch assembly 60 is run further into mating assembly 56 in downhole direction 124. As illustrated, collet engagement surface 100 of latch collet 98 is engaged with mating engagement surface 76 of mating mandrel 68. For example, latch collet 98 may flex to allow fingers 104 to ratchet into mating assembly 56. While latch collet 98 may be engaged with mating mandrel 68, resettable latch assembly 60 may not be considered latched to mating mandrel 68 as latch mandrel 154 is not positioned behind fingers 104 at collet engagement surface 100. With application of force to resettable latch assembly 60 in an opposite direction to downhole direction 124, latch collet 98 may be come disengaged from mating mandrel 68. For example, force may be applied to resettable latch assembly 60 in the opposite direction to the downhole direction 124 until latch collet 98 disengages from mating mandrel 68. More specifically, latch collet 98 may flex to allow fingers 104 to disengage from mating engagement surface 76, allowing the latch collet 98 to ratchet out of mating assembly 56. With reference again to FIG. 17, resettable latch assembly 60 may be pulled out of mating assembly 56. With resettable latch assembly 60 released, resettable latch assembly 60 can be retrieved from borehole (e.g., borehole 38 on FIG. 1) or reset with downward movement. For example, resettable latch assembly 60 is in its run-in configuration and can be reset and latched into mating mandrel 68 with downward movement. The resettable latch assembly 60 can be reset into the mating mandrel 68 and then pulled out of the mating mandrel 68 as many times as needed. This sequence of steps can be repeated as many times as necessary for operation without needing to trip resettable latch assembly 60 of out of a borehole (e.g., borehole 38 on FIG. 1). For example, this sequency may be repeated multiple times to confirm a desirable connection has been obtained, for example, between energy transfer line (e.g., energy transfer line 64 on FIG. 17) and downhole equipment.

Figure 19:
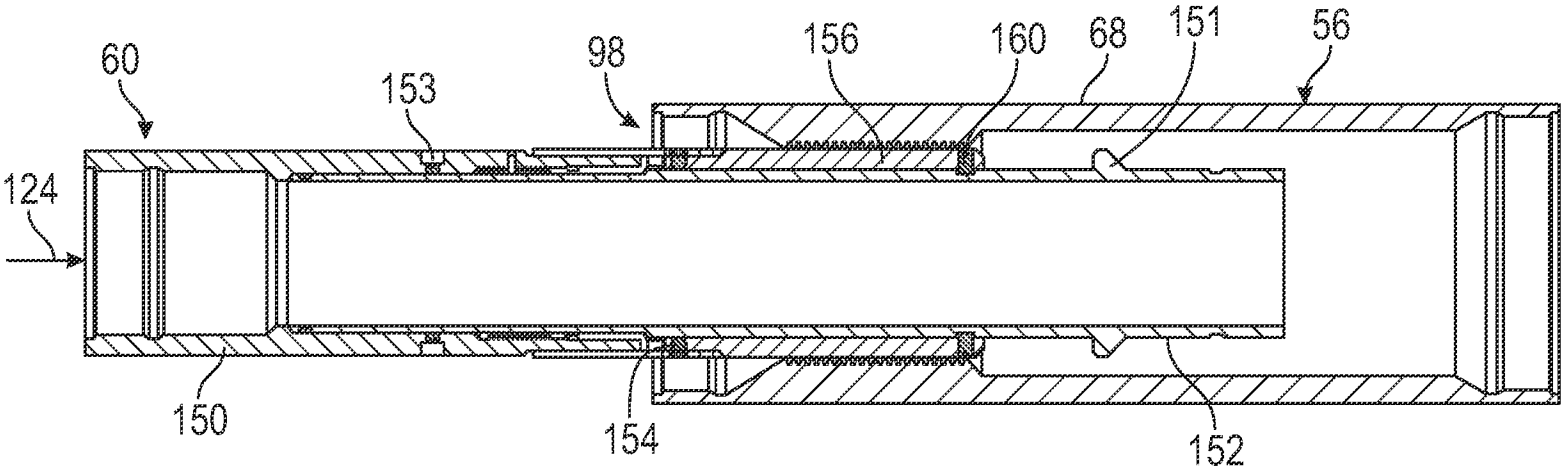
FIG. 19 is a cross-sectional view of the resettable latch assembly of FIG. 17 and a mating receptacle in accordance with some embodiments.
Figure 20:
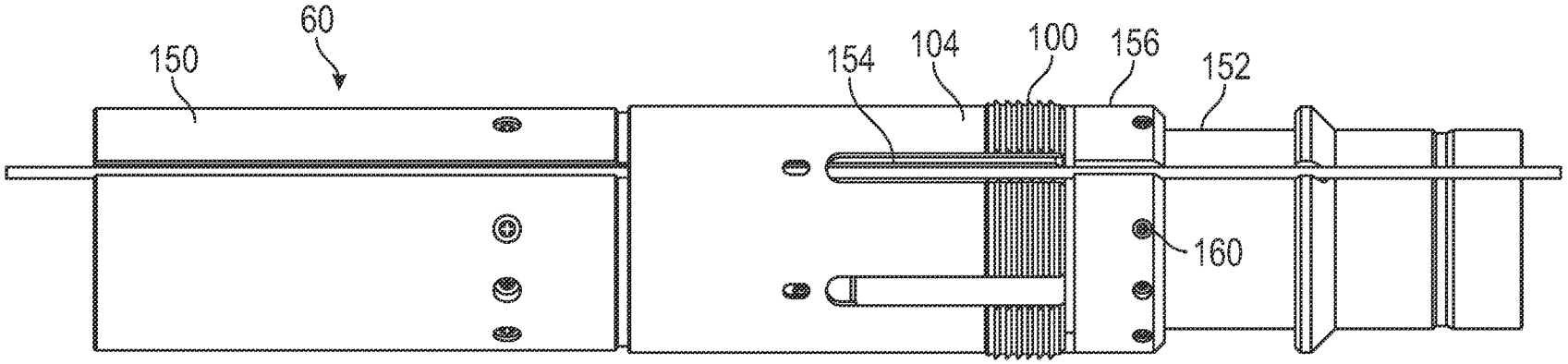
FIG. 20 is a side view of the resettable latch assembly of FIG. 17 in accordance with some embodiments.

With reference to FIG. 18, resettable latch assembly 60 is shown positioned in mating mandrel 68 with fingers 104 of latch collet 98 in engagement with mating mandrel 68. In this position, upper mandrel 150 is secured to lower mandrel 152 with upper shear members 153, and sleeve 156 is secured to lower mandrel 152 with lower shear members 160. To lock the latch collet 98 in mating mandrel 68, downward force may be applied to resettable latch assembly 60 in downhole direction 124. While not shown, a feature on resettable latch assembly 60 may engage a downhole tool (not shown) to limit further downhole movement. For example, landing shoulder 151 of lower mandrel 152 may engage a downhole tool (not shown) to limit further downhole movement. Turning now to FIGS. 19 and 20, with downhole movement limited at lower mandrel 152, downward force may be applied to resettable latch assembly 60 until upper shear members 153 are sheared, thus detaching upper mandrel 150 from lower mandrel 152. Upper mandrel 150 may then move downhole pushing latch mandrel 154 further downhole while latch collet 98 remains stationary. Latch mandrel 154 may be positioned under fingers 104 at collet engagement surface 100. In this position, resettable latch assembly 60 may be considered in a latched configuration with latch mandrel 154 positioned behind fingers 104 at collet engagement surface 100. This limits the movement of fingers 104 inward to lower mandrel 152, latching resettable latch assembly 60 to mating assembly 56. As can be seen on FIG. 19, upper mandrel 150 has reengaged lower mandrel 152 in this position. For example, body lock ring 162 on lower mandrel 152 engages upper mandrel 150 to secure them together while the fingers are supported. The body lock ring 162, for example, may be engaged to threads on the lower mandrel 152 and the upper mandrel 150. Lower shear members 160 may secure sleeve 156 to lower mandrel 152.

Figure 21:
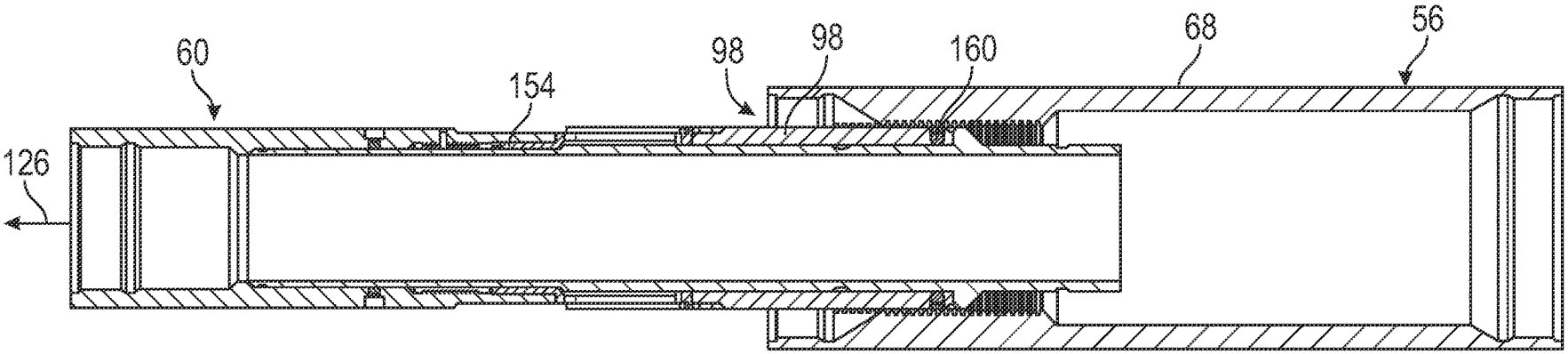
FIG. 21 is a cross-sectional view of the resettable latch assembly of FIG. 17 and a mating receptacle in accordance with some embodiments.
Figure 22:
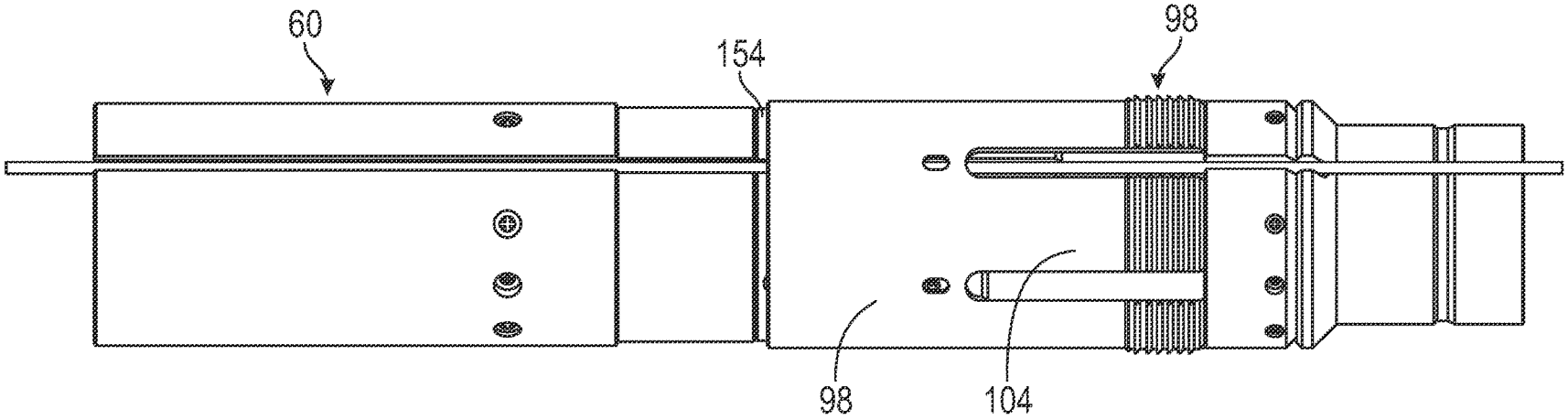
FIG. 22 is a side view of the resettable latch assembly of FIG. 17 in accordance with some embodiments.

With reference to FIGS. 21 and 22, release of resettable latch assembly 60 from mating assembly 56 will now be described in accordance with some embodiments. With latch collet 98 secured to mating mandrel 68, resettable latch assembly 60 may be pulled in uphole direction 126 until lower shear members 160 are sheared, thus allowing resettable latch assembly 60 to be pulled uphole while latch collet 98 remains locked to mating mandrel 68. Resettable latch assembly 60 is moved uphole causing latch mandrel 154 to also move uphole leaving fingers 104 of latch collet 98 unsupported. With fingers 104 unsupported, latch collet 98 may ratchet out of mating mandrel 68 to disengage. Resettable latch assembly 60 may then be pulled from borehole.

Figure 23:
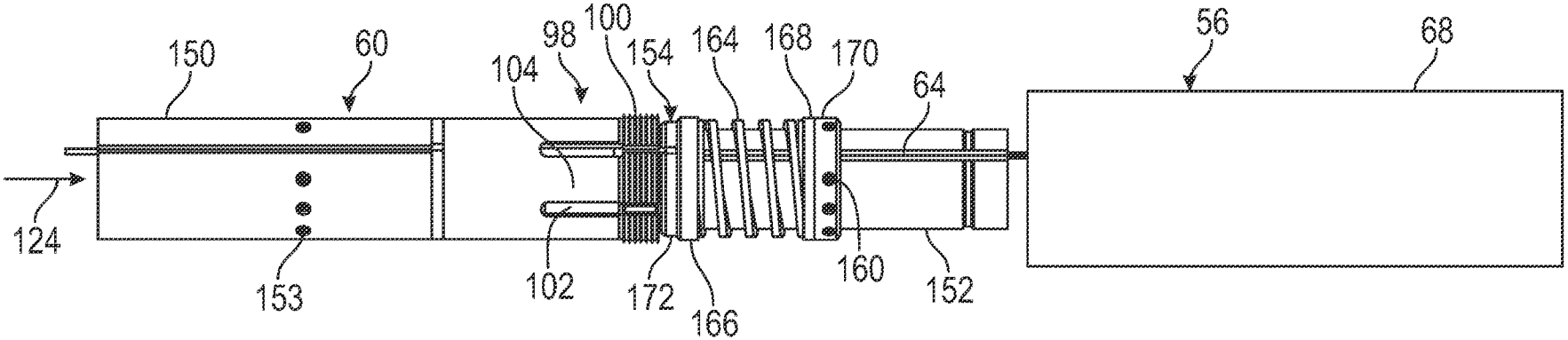
FIG. 23 is a side view of a mating receptacle and resettable latch assembly with an energy transfer line in accordance with some embodiments.

FIGS. 23-27 are multiple views of an alternative embodiment of a resettable latch assembly 60 in accordance with some embodiments. FIG. 23 illustrates resettable latch assembly 60 in a run-in configuration before positioning in mating assembly 56. FIGS. 24-27 illustrate the additional steps for latching resettable latch assembly 60 to a mating mandrel 68 of mating assembly 56 with the latch collet 98, releasing resettable latch assembly 60 from mating mandrel 68, and then relatching resettable latch assembly 60 to mating mandrel 68, in accordance with some embodiments.

With reference to FIG. 23, resettable latch assembly 60 is illustrated in accordance with some embodiments. As illustrated, resettable latch assembly 60 comprises an upper mandrel 150 and a lower mandrel 152 attached to one another. Upper shear members 153 may secure the upper mandrel 150 to lower mandrel. Resettable latch assembly 60 may also comprise a latch collet 98 on lower mandrel 152. As will be discussed in more detail below the latch collet 98 may releasably latch the resettable latch assembly 60 to a downhole tool (e.g., mating mandrel 68). Resettable latch assembly 60 may further comprise a latch mandrel 154 that at least partially extends under latch collet 98. Latch mandrel 154 may be secured to the upper mandrel 150, for example, by a threaded connection. Resettable latch assembly 60 may further comprise a spring 164 positioned between two rings, upper ring 166 and lower ring 168. A shear ring 170 may be positioned on lower mandrel 152 downhole from spring 164. Also illustrated on FIG. 23 is energy transfer line 64. As illustrated, energy transfer line 64 extends along resettable latch assembly 60. In some embodiments, the energy transfer line 64 may be attached to an exterior of resettable latch assembly 60. For example, the energy transfer line 64 may be carried in a groove on the resettable latch assembly 60. However, the energy transfer line 64 may be otherwise configured, for example, the energy transfer line may be positioned inside resettable latch assembly 60. While only a single energy transfer line 64 is shown, it should be understood that the resettable latch assembly 60 may carry multiple energy transfer lines 64.

Resettable latch assembly 60 also may comprise latch mandrel 154. As illustrated, latch mandrel 154 may be carried on lower mandrel 152 and may be disposed about lower mandrel 152. Latch mandrel 154 may be coupled to upper mandrel 150, for example, with a threaded connection. Latch mandrel 154 may extend at least partially under latch collet 98. Latch mandrel 154 may be initially positioned as shown on FIG. 23, for example, during run-in, in a position that does not support fingers 104 of latch collet 98. Latch mandrel 154 may comprise a collar 172 that may be positioned downhole from latch collet 98 in a run-in configuration.

Resettable latch assembly 60 may comprise latch collet 98. As illustrated, latch collet 98 may ride on latch mandrel 154 and may be disposed about latch mandrel 154. Latch collet 98 may comprise a collet engagement surface 100 that may be used to mate with a corresponding engagement surface (e.g., mating engagement surface 76 on FIG. 2). Collet engagement surface 100 may engage with the corresponding engagement surface in any suitable type of engagement, such as ratchet-latch type. Thus, collet engagement surface 100 and/or the corresponding engagement surface may comprise teeth (e.g., collet engagement surface 100 in this embodiment), and the other one of the engagement surfaces may comprise corresponding teeth or a threaded surface (e.g., mating engagement surface 76 on FIG. 2 in this embodiment). In the illustrated embodiment, collet engagement surface 100 may be formed on an outer surface at an end of latch collet 98.

Latch collet 98 may be radially flexible (e.g., radially compressible and/or expandable) with respect to latch mandrel 154 and lower mandrel 152, for the engagement surfaces to engage and disengage with each other. For example, latch collet 98 may comprise a plurality of slots 102 to define a plurality of fingers 104 disposed radially around latch collet 98 with collet engagement surface 100 formed upon fingers 104 to facilitate latch collet 98 flexing or bending with respect to latch mandrel 154 and lower mandrel 152 (or mating mandrel 68). Latch collet 98 may be able to move axially with respect to lower mandrel 152. Further, though not necessary, latch collet 98 may be rotationally constrained with respect to lower mandrel 152 such that latch collet 98 is not able to rotate about or with respect to lower mandrel 152. Collar 172 of latch mandrel 154 may be positioned downhole of latch collet 98 to limit relative movement of latch collet 98 and lower mandrel 152. As illustrated, collar 172 may engage latch collet 98 to prevent its downward movement on lower mandrel 152.

Resettable latch assembly 60 may comprise spring 164. Spring 164 may ride on lower mandrel 152 and be positioned downhole of latch mandrel. Spring 164 may be positioned between upper ring 166 and lower ring 168. As illustrated, upper ring 166 may engage collar 172 of latch mandrel 154. Spring 164 and upper and lower rings 166, 168 may slide on lower mandrel 152. Downward movement of spring 164 on lower mandrel 152 may be limited by shear ring 170. Shear ring 170 may be attached to lower mandrel 152 with lower shear members 160.

Figure 24:
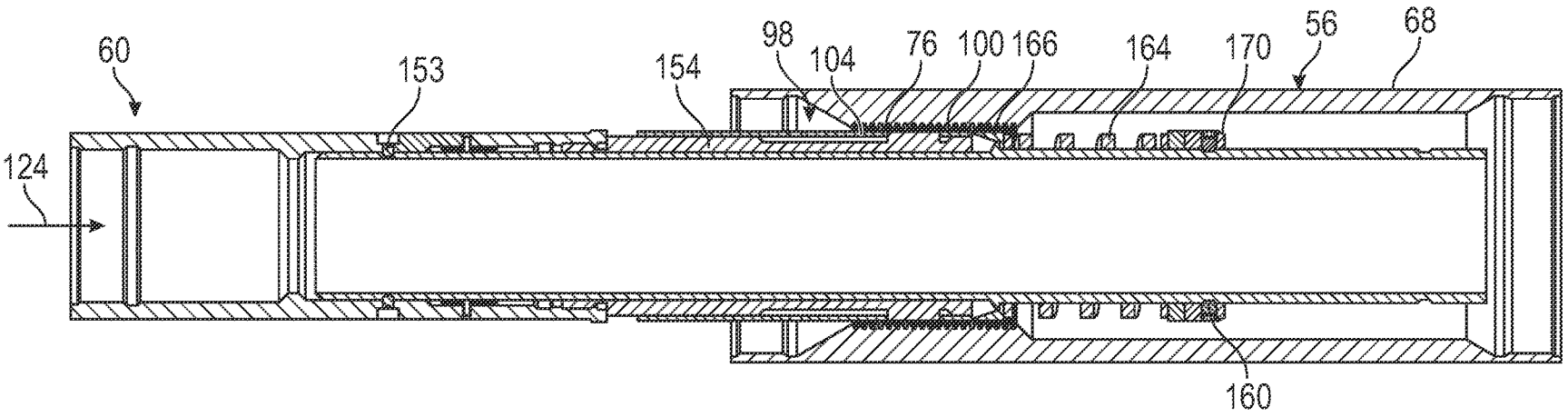
FIG. 24 is a cross-sectional view of the mating receptacle and resettable latch assembly of FIG. 23 in accordance with some embodiments.
Figure 25:
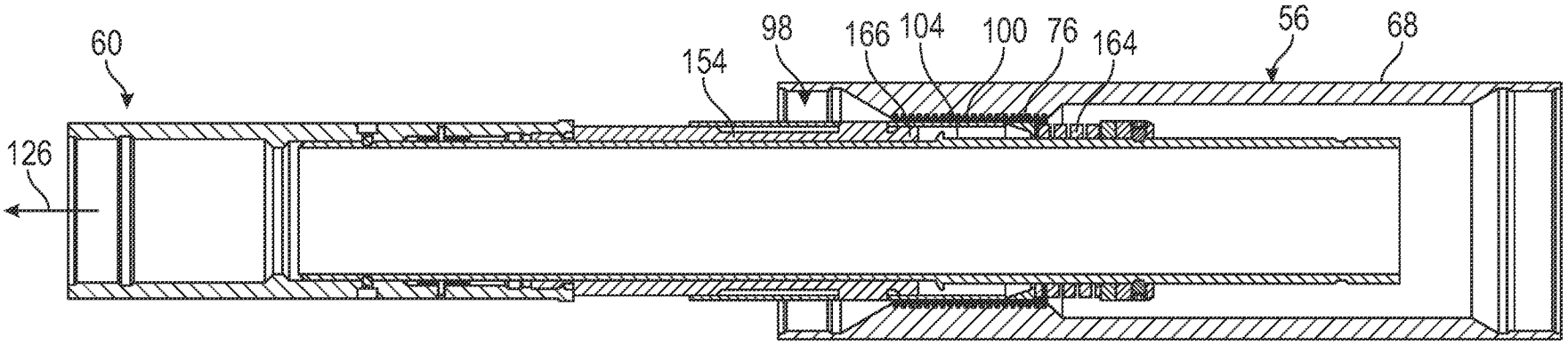
FIG. 25 is a cross-sectional view of the mating receptacle and the resettable latch assembly of FIG. 23 in accordance with some embodiments.

With reference to FIGS. 23-27, the sequence of steps for operating resettable latch assembly 60 to latch with mating assembly 56 will now be described in accordance with some embodiments. As illustrated in FIG. 23, resettable latch assembly 60 may be run into a borehole (e.g., borehole 38 on FIG. 1) and into mating assembly 56 in downhole direction 124. In this run-in configuration, collar 172 of latch mandrel 154 does not support the fingers 104 of resettable latch assembly 60, such that fingers 104 are free to flex inward toward lower mandrel 152. Turning now to FIG. 24, resettable latch assembly 60 is run further into mating assembly 56 in downhole direction 124. As illustrated, collet engagement surface 100 of latch collet 98 is engaged with mating engagement surface 76 of mating mandrel 68. For example, latch collet 98 may flex to allow fingers 104 to ratchet into mating assembly 56. With slight movement of resettable latch assembly 60 in a direction opposite downhole direction 124, latch mandrel 152 moves upward on lower mandrel 152 to position collar 172 behind fingers 104 at collet engagement surface 100. In this position, latch collet 98 may be considered latched to mating mandrel 68 with fingers 104 supported by collar 172 of latch mandrel 154. To release the latch, resettable latch assembly 60 may be further pulled in uphole direction 126, as shown on FIG. 25. By pulling in uphole direction 126, spring 164 may be compressed and latch mandrel 154 may move further uphole with respect to latch collet 98 until fingers 104 at collet engagement surface 100 may not be supported by collar 154 of latch mandrel 154. With fingers 104 unsupported, latch collet 98 may flex to allow fingers 104 to disengage from mating engagement surface 76, allowing the latch collet 98 to ratchet out of mating assembly 56. With reference again to FIG. 23, resettable latch assembly 60 may be pulled out of mating assembly 56. With resettable latch assembly 60 released, resettable latch assembly 60 can be retrieved from borehole (e.g., borehole 38 on FIG. 1) or reset with downward movement. For example, resettable latch assembly 60 is in its run-in configuration and can be reset and latched into mating mandrel 68 with downward movement, as shown on FIG. 24. The resettable latch assembly 60 can be reset into the mating mandrel 68 and then pulled out of the mating mandrel 68 as many times as needed. This sequence of steps can be repeated as many times as necessary for operation without needing to trip resettable latch assembly 60 of out of a borehole (e.g., borehole 38 on FIG. 1). For example, this sequency may be repeated multiple times to confirm a desirable connection has been obtained, for example, between energy transfer line (e.g., energy transfer line 64 on FIG. 23) and downhole equipment.

Figure 26:
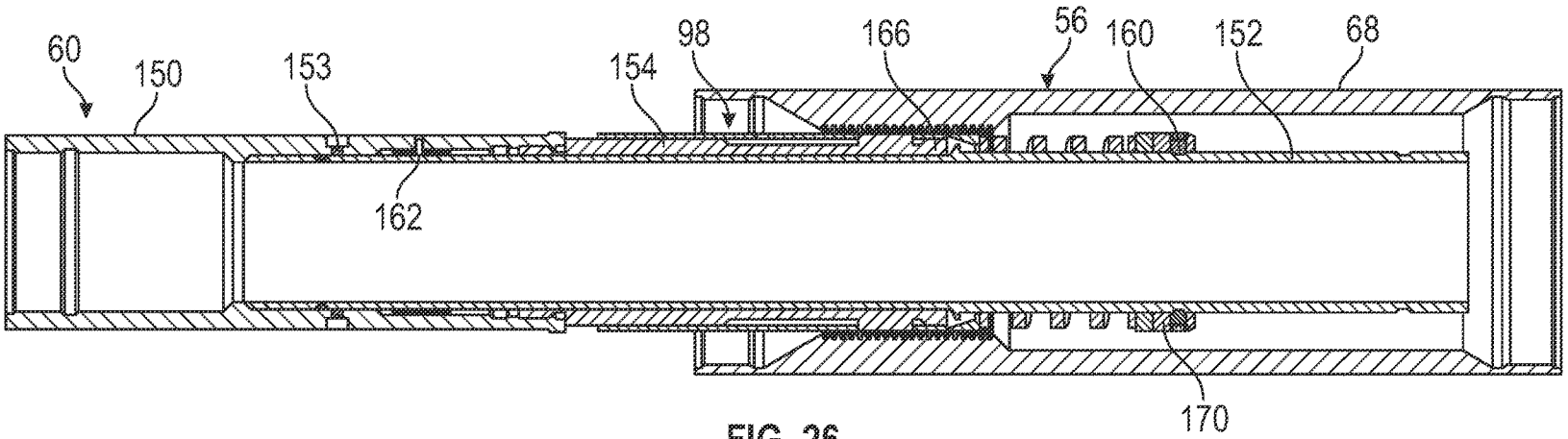
FIG. 26 is a cross-sectional view of the mating receptacle and the resettable latch assembly of FIG. 23 in accordance with some embodiments.

With reference to FIG. 24, resettable latch assembly 60 is shown positioned in mating mandrel 68 with fingers 104 of latch collet 98 in engagement with mating mandrel 68. In this position, upper mandrel 150 is secured to lower mandrel 152 with upper shear members 153, and shear ring 170 is secured to lower mandrel 152 with lower shear members 160. To lock the latch collet 98 in mating mandrel 68, downward force may be applied to resettable latch assembly 60 in downhole direction 124. Turning now to FIG. 26, with downhole movement limited at lower mandrel 152, downward force may be applied to resettable latch assembly 60 until upper shear members 153 are sheared, thus detaching upper mandrel 150 from lower mandrel 152. Upper mandrel 150 may then move downhole pushing latch mandrel 154 further downhole while latch collet 98 remains stationary. Upper mandrel 150 may be moved downward until body lock ring 162 on lower mandrel 152 engages upper mandrel 150 to secure them together while the fingers 104 are supported. In this position, the upper movement of latch mandrel 154 may be limited locking the latch collet 98 in engagement with mating mandrel 68. Collar 172 of latch mandrel 154 may be positioned under fingers 104 at collet engagement surface 100. In this position, resettable latch assembly 60 may be considered in a latched configuration with latch mandrel 154 positioned behind fingers 104 at collet engagement surface 100. This limits the movement of fingers 104 inward to lower mandrel 152, latching resettable latch assembly 60 to mating assembly 56. Lower shear members 160 may secure shear ring 170 to lower mandrel 152.

Figure 27:
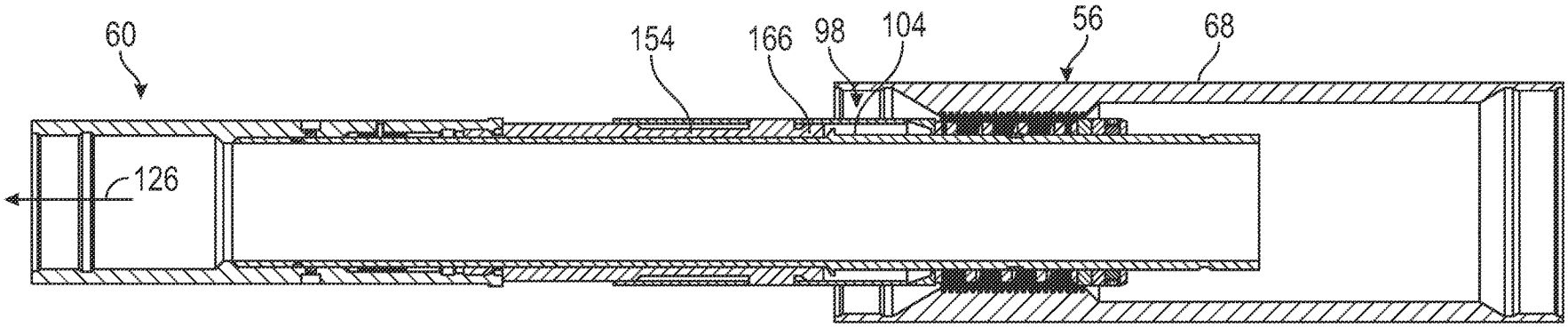
FIG. 27 is a cross-sectional view of the mating receptacle and the resettable latch assembly of FIG. 23 in accordance with some embodiments.

With reference to FIG. 27, release of resettable latch assembly 60 from mating assembly 56 will now be described in accordance with some embodiments. With latch collet 98 secured to mating mandrel 68, resettable latch assembly 60 may be pulled in uphole direction 126 until lower shear members 160 are sheared, thus allowing resettable latch assembly 60 to be pulled in uphole direction 126 while latch collet 98 remains locked to mating mandrel 68. Resettable latch assembly 60 is moved uphole causing latch mandrel 154 until collar 172 no longer support fingers 104. With fingers 104 unsupported, latch collet 98 may ratchet out of mating mandrel 68 to disengage. Resettable latch assembly 60 may then be pulled from borehole.

Accordingly, FIGS. 23-27 illustrate the sequence of steps for latching, releasing, and relatching of resettable latch assembly 60 into mating assembly 56 in accordance with some embodiments. This sequence of steps can be repeated as many times as necessary for operation without needing to trip resettable latch assembly 60 of out of a borehole (e.g., borehole 38 on FIG. 1). For example, this sequency may be repeated multiple times to confirm a desirable connection has been obtained, for example, between energy transfer line (e.g., energy transfer line 64 on FIG. 23) and downhole equipment.

Accordingly, the present disclosure may provide a resettable latch assembly that lands and latches in a mating assembly with feed through of an energy transfer line(s). The methods, systems, and tools may include any of the various features disclosed herein, including one or more of the following statements.

Statement 1. A resettable latch assembly for latching downhole to a mating mandrel, comprising: a mandrel; a latch collet disposed on the mandrel, wherein the latch collet is radially flexibly with respect to the mating mandrel; and an energy transfer line extending a length of the mandrel; wherein the resettable latch assembly is latchable, releasable, and relatchable to the mating mandrel with translational movement.

Statement 2. The resettable latch assembly of statement 1, wherein the mandrel is a lower mandrel, and wherein the resettable latch assembly further comprises: an upper mandrel coupled to the lower mandrel with upper shear members; a latch mandrel coupled to the upper mandrel that is disposed on the lower mandrel and at least partially extends between the latch collet and the lower mandrel; and a sleeve disposed on the lower mandrel and coupled to the lower mandrel with shear members, wherein the sleeve comprises a collar engageable with the latch collet to limit downward movement of the latch collet on the lower mandrel.

Statement 3. The resettable latch assembly of statement 2, wherein lower mandrel comprises a body lock ring engagement with the upper mandrel.

Statement 4. The resettable latch assembly of statement 2 or statement 3, wherein the lower mandrel comprises a collar spaced on the lower mandrel from the sleeve.

Statement 5. The resettable latch assembly of any one of statements 2 to 4, wherein the collar of the sleeve is positionable under the latch mandrel to support fingers of the latch mandrel locking the latch collet to the mating mandrel.

Statement 6. The resettable latch assembly of statement 1, wherein the resettable latch assembly further comprises: a landing shoulder disposed on the mandrel below the latch collet; and a locking collet disposed on the mandrel and axially moveable with respect to the mandrel from a locked position to an unlocked position, wherein, in the locked position, the locking collet is configured to remain axially stationary with respect to the mandrel.

Statement 7. The resettable latch assembly of statement 6, wherein the locking collet and the latch collet are a unitary member with the latch collet positioned below the locking collet.

Statement 8. The resettable latch assembly of statement 6 or statement 7, wherein the latch collet is positioned below the locking collet, and wherein the locking collet comprises a collet shoulder that extends inward from the locking collet, and wherein the mandrel comprises a first mandrel groove and a second mandrel groove, and wherein the locking collet is in the locked position when the collet shoulder is positioned in either of the first mandrel groove or the second mandrel groove.

Statement 9. The resettable latch assembly of any one of statements 6 to 8, wherein the latch collet is positioned uphole from the locking collet, and wherein the landing shoulder is disposed on an uphole end of the locking collet, ands wherein the locking collet comprise a sleeve locking feature that engages a mandrel locking feature to lock the locking collet in the locked position.

Statement 10. The resettable latch assembly of statement 9, further comprising a snap ring disposed on the mandrel uphole from the latch collet that is engageable with the latch collet to restrict axial movement of the latch collet with respect to the mandrel in an uphole direction.

Statement 11. The resettable latch assembly of statement 1, wherein the mandrel is a lower mandrel, and wherein the resettable latch assembly further comprises: an upper mandrel coupled to the lower mandrel with upper shear members; a latch mandrel coupled to the upper mandrel that is disposed on the lower mandrel and at least partially extends between the latch collet and the lower mandrel, wherein the latch mandrel comprises a collar below the latch collet, wherein the latch mandrel is under the latch mandrel to support fingers of the latch mandrel locking the latch collet to the mating mandrel; and a spring disposed on the lower mandrel below the latch mandrel; and a shear ring disposed on the lower mandrel below the spring that limits downward movement of the spring, wherein the shear ring is coupled to the lower mandrel with lower shear members.

Statement 12. The resettable latch assembly of any one of statements 1 to 11, wherein the latch collet comprises a plurality of slots to define a plurality of fingers, and wherein the latch collet is engageable with the mating mandrel with the plurality of fingers to latch the resettable latch assembly to the mating mandrel.

Statement 13. The resettable latch assembly of any one of statements 1 to 12, wherein the mandrel comprises a latch support feature that is positionally behind the fingers at a collet engagement surface to latch the resettable latch assembly to the mating mandrel.

Statement 14. The resettable latch assembly of statement 13, wherein the latch support feature comprises a radial extension from the mandrel.

Statement 15. The resettable latch assembly of any one of statements 1 to 14, wherein the energy transfer line comprises a fiberoptic line.

Statement 16. A method for latching to a mating mandrel, comprising: running a resettable latch assembly into the mating mandrel positioned in a borehole, wherein the resettable latch assembly comprises an energy transfer line; engaging a collet engagement surface of the resettable latch assembly with a mating engagement surface of the mating mandrel to latch to resettable latch assembly in the mating mandrel; disengaging the resettable latch assembly from the mating mandrel by moving the resettable latch assembly uphole without rotation; and moving the resettable latch assembly downhole to reengage the collet engagement surface of the resettable latch assembly with the mating engagement surface of the mating mandrel to latch the resettable latch assembly in the mating mandrel; coupling the energy transfer line to a downhole energy transfer line; and supporting fingers of the latch mandrel at the collet engagement surface to lock the latch mandrel on the mating mandrel.

Statement 17. The method of statement 16, wherein moving the resettable latch assembly downhole to reengage the collet engagement surface of the resettable latch assembly with the mating engagement surface further comprises landing a lower mandrel of the resettable latch assembly in the mating mandrel to limit downward movement of the resettable latch assembly and then applying additional downward force to the resettable latch assembly such that upper shear members holding the lower mandrel to an upper mandrel of the resettable latch assembly are sheared.

Statement 18. The method of statement 17, wherein the supporting fingers of the latch mandrel comprises, after the upper shear members are sheared, moving the upper mandrel further downhole to cause a latch mandrel associated with the upper mandrel and that is disposed on the lower mandrel to also move downhole behind the fingers of the latch mandrel to support the fingers at the collet engagement surface.

Statement 19. The method of statement 17 or statement 18, wherein a collar of a sleeve is positioned on the lower mandrel downhole from the latch collet to limit downward movement of the latch collet.

Statement 20. The method of statement 19, wherein the method further comprises, after the supporting the fingers of the latch mandrel, applying uphold force to the resettable latch assembly to shear lower shear members holding the sleeve to the lower mandrel and then moving the resettable latch assembly uphole to remove the resettable latch assembly from the borehole.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A resettable latch assembly for latching downhole to a mating mandrel, comprising:

a mandrel;

a latch collet disposed on the mandrel, wherein the latch collet is radially flexible with respect to the mating mandrel; and an energy transfer line extending a length of the mandrel;

wherein the resettable latch assembly is latchable, releasable, relatchable to the mating mandrel with translational movement, wherein the mandrel is a lower mandrel, and wherein the resettable latch assembly further comprises:

an upper mandrel coupled to the lower mandrel with upper shear members;

a latch mandrel coupled to the upper mandrel that is disposed on the lower mandrel and at least partially extends between the latch collet and the lower mandrel; and a sleeve disposed on the lower mandrel and coupled to the lower mandrel with shear members, wherein the sleeve comprises a collar engageable with the latch collet to limit downward movement of the latch collet on the lower mandrel.

2. The resettable latch assembly of claim 1, wherein lower mandrel comprises a body lock ring engagement with the upper mandrel.

3. The resettable latch assembly of claim 1, wherein the lower mandrel comprises a collar spaced on the lower mandrel from the sleeve.

4. The resettable latch assembly of claim 1, wherein the collar of the sleeve is positionable under the latch mandrel to support fingers of the latch mandrel locking the latch collet to the mating mandrel.

5. The resettable latch assembly of claim 1, wherein the resettable latch assembly further comprises:

a landing shoulder disposed on the mandrel below the latch collet; and a locking collet disposed on the mandrel and axially moveable with respect to the mandrel from a locked position to an unlocked position, wherein, in the locked position, the locking collet is configured to remain axially stationary with respect to the mandrel.

6. The resettable latch assembly of claim 5, wherein the locking collet and the latch collet are a unitary member with the latch collet positioned below the locking collet.

7. The resettable latch assembly of claim 5, wherein the latch collet is positioned below the locking collet, and wherein the locking collet comprises a collet shoulder that extends inward from the locking collet, and wherein the mandrel comprises a first mandrel groove and a second mandrel groove, and wherein the locking collet is in the locked position when the collet shoulder is positioned in either of the first mandrel groove or the second mandrel groove.

8. The resettable latch assembly of claim 1, wherein the latch collet comprises a plurality of slots to define a plurality of fingers, and wherein the latch collet is engageable with the mating mandrel with the plurality of fingers to latch the resettable latch assembly to the mating mandrel.

9. The resettable latch assembly of claim 1, wherein the mandrel comprises a latch support feature that is positionally behind the fingers at a collet engagement surface to latch the resettable latch assembly to the mating mandrel.

10. The resettable latch assembly of claim 9, wherein the latch support feature comprises a radial extension from the mandrel.

11. The resettable latch assembly of claim 1, wherein the energy transfer line comprises a fiberoptic line.

12. A resettable latch assembly for latching downhole to a mating mandrel, comprising:

a mandrel;

a locking collet disposed on the mandrel and axially moveable with respect to the mandrel from a locked position to an unlocked position, wherein, in the locked position, the looking collet is configured to remain axially stationary with respect to the mandrel, further wherein the locking collet comprises a sleeve locking feature that engages a mandrel locking feature to lock the locking collet in the locked position;

a latch collet disposed on the mandrel, wherein e latch collet is radially flexible with respect to the mating mandrel, and further wherein the latch collet is positioned uphole from the locking collet;

a landing shoulder disposed on the mandrel below the latch collet, wherein the landing shoulder is disposed on an uphole end of the locking collet;

an energy transfer fine extending a length of the mandrel;

wherein the resettable latch assembly is latchable, releasable, relatchable to the mating mandrel with translational movement.

13. The resettable latch assembly of claim 12, further comprising a snap ring disposed on the mandrel uphole from the latch collet that is engageable with the latch collet to restrict axial movement of the latch collet with respect to the mandrel in an uphole direction.

14. A resettable latch assembly for latching downhole toto a mating mandrel, comprising:

a mandrel wherein the mandrel is a lower mandrel;

a latch collet disposed on the mandrel, wherein the latch collet is radially flexible with respect to the mating mandrel; and an energy transfer line extending a length of the mandrel;

wherein the resettable latch assembly is latchable, releasable, and relatchable to the mating mandrel with translational movement, and wherein the resettable latch assembly further comprises:

an upper mandrel coupled to the lower mandrel with upper shear members;

a latch mandrel coupled to the upper mandrel that is disposed on the lower mandrel and at least partially s bet the latch collet and the lower mandrel, wherein the latch mandrel comprises a co lar below the latch collet, wherein the latch mandrel is under the latch mandrel to support fingers of the latch mandrel locking the latch collet to the mating mandrel; and a spring disposed on the lower mandrel below the latch mandrel; and a shear ring disposed on the lower mandrel below the spring that limits downward movement of the spring wherein the shear ring is coupled to the lower man with lower shear members.

15. A method for latching to a mating mandrel, comprising:

running a resettable latch assembly into the mating mandrel positioned in a borehole, wherein the resettable latch assembly comprises an energy transfer line;

engaging a collet engagement surface of the resettable latch assembly with a mating engagement surface of the mating mandrel to latch to resettable latch assembly in the mating mandrel;

disengaging the resettable latch assembly from the mating mandrel by moving the resettable latch assembly uphole without rotation;

moving the resettable latch assembly downhole to reengage the collet engagement surface of the resettable latch assembly with the mating engagement surface of the mating mandrel to latch the resettable latch assembly in the mating mandrel;

coupling the energy transfer line to a downhole energy transfer line; and supporting fingers of the latch mandrel at the collet engagement surface to lock the latch mandrel on the mating mandrel, wherein:

moving the resettable latch assembly downhole to reengage the collet engagement surface of the resettable latch assembly with the mating engagement surface further comprises landing a lower mandrel of the resettable latch assembly in the mating mandrel to limit downward movement of the resettable latch assembly; and then applying additional downward force to the resettable latch assembly such that upper shear members holding the lower mandrel to an upper mandrel of the resettable latch assembly are sheared.

16. The method of claim 15, wherein the supporting fingers of the latch mandrel comprises, after the upper shear members are sheared, moving the upper mandrel further downhole to cause a latch mandrel associated with the upper mandrel and that is disposed on the lower mandrel to also move downhole behind the fingers of the latch mandrel to support the fingers at the collet engagement surface.

17. The method of claim 15, wherein a collar of a sleeve is positioned on the lower mandrel downhole from the latch collet to limit downward movement of the latch collet.

18. The method of claim 17, wherein the method further comprises, after the supporting the fingers of the latch mandrel, applying uphold force to the resettable latch assembly to shear lower shear members holding the sleeve to the lower mandrel and then moving the resettable latch assembly uphole to remove the resettable latch assembly from the borehole.

* * * * *